US007614354B2

(12) United States Patent
Suzuki et al.

(10) Patent No.: US 7,614,354 B2
(45) Date of Patent: Nov. 10, 2009

(54) BOBBIN CHANGER APPARATUS FOR SEWING MACHINE

(75) Inventors: Satoru Suzuki, Komaki (JP); Isao Ohashi, Komaki (JP); Takuya Okamoto, Komaki (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 179 days.

(21) Appl. No.: 11/774,030

(22) Filed: Jul. 6, 2007

(65) Prior Publication Data

US 2008/0011213 A1 Jan. 17, 2008

(30) Foreign Application Priority Data

Jul. 11, 2006 (JP) ..... 2006-190358

(51) Int. Cl.
*D05B 59/04* (2006.01)
*D05B 57/06* (2006.01)

(52) U.S. Cl. ..... 112/186

(58) Field of Classification Search ..... 112/186, 112/180, 470.01, 470.05; 242/473.5
See application file for complete search history.

(56) References Cited

U.S. PATENT DOCUMENTS 2,690,725 A * 10/1954 Schumann et al. ..... 112/186
5,718,181 A * 2/1998 Shinozuka et al. ..... 112/186
5,775,243 A * 7/1998 Kinoshita et al. ..... 112/186
6,041,725 A * 3/2000 Resta ..... 112/470.05
6,170,417 B1 * 1/2001 Kinoshita et al. ..... 112/470.01

FOREIGN PATENT DOCUMENTS

JP 8-196766 A 8/1996
JP 2000-157774 A 6/2000
WO 2005/047586 A1 5/2005

* cited by examiner

*Primary Examiner*—Ismael Izaguirre
(74) *Attorney, Agent, or Firm*—Rossi, Kimms & McDowell, LLP

(57) ABSTRACT

Bobbin case containing a lower thread bobbin mounted in a rotary hook of a sewing machine is exchanged for a new bobbin case by the bobbin case being transferred between the rotary hook and a bobbin stock section provided apart from the rotary hook. Transfer mechanism reciprocatively transfers a bobbin grasping device, grasping a bobbin case at a distal end portion of a chuck section, between the rotary hook and the bobbin stock section. In a predetermined position of a transfer stroke of the bobbin grasping device, an orientation change mechanism changes the orientation of the chuck section, being transferred toward the rotary hook, so that the chuck section faces toward the rotary hook, and changes the orientation of the chuck section of the bobbin grasping device, being transferred toward the bobbin stock section, so that the chuck section faces toward the bobbin stock section.

6 Claims, 16 Drawing Sheets

BOBBIN CHANGER APPARATUS FOR SEWING MACHINE

BACKGROUND OF THE INVENTION

The present invention relates to a bobbin changer apparatus for automatically changing or replacing a bobbin case, containing a lower thread bobbin, mounted in a rotary hook of a sewing machine.

Lower thread change apparatus are arranged to, when a bobbin, contained in a bobbin case mounted in a rotary hook supported on a rotary hook base, has run out of a lower thread, automatically replace the empty bobbin case with a new or replacement bobbin case containing a bobbin with a sufficient supply of lower thread thereon, and such lower thread change apparatus have been commonly known as "bobbin changers" or "bobbin changer apparatus" (e.g., Japanese Patent Application Laid-open Publication No. HEI-8-196766 which will hereinafter be referred to as "Patent Literature 1"). Further, in Japanese Patent Application Laid-open Publication No. 2000-157774 (hereinafter referred to as "Patent Literature 2"), there is disclosed a multi-head sewing machine equipped with a plurality of machine heads, where a bobbin changer is provided for each of the machine heads (i.e., for each of rotary hook bases) and drive mechanisms of the individual bobbin changers are drivable via a same or common drive source.

In the bobbin changer disclosed in Patent Literature 2, a bobbin stock section (or bobbin changing cassette) is disposed adjacent to the front end edge of a sewing table closer to a human operator, and a transfer mechanism is provided to reciprocally transfer a bobbin grasping device (or bobbin chuck mechanism) between the rotary hook supported on the rotary hook base located beneath the machine head disposed adjacent to the rear end edge of the sewing table and the bobbin stock section. The bobbin stock section (or bobbin changing cassette) is equipped with a plurality of bobbin cases and receives and delivers bobbin cases to and from (i.e., exchange bobbin cases with) the bobbin changer. Namely, when a thread wound on a lower thread bobbin mounted in any one of the rotary hooks has run short or run out, the bobbin grasping device is moved or transferred, via the transfer mechanism, to the rotary hook in response to a lower thread runout detection signal, takes out, from the rotary hook, the bobbin case containing the empty bobbin, then transferred, via the transfer mechanism, to the bobbin stock section with the taken-out bobbin case grasped by the device, and then delivers the bobbin case to an empty bobbin stock position of the bobbin stock section. After that, the bobbin stock section is rotated through a predetermined angle to allow the bobbin grasping device to take out a new or replacement bobbin case, containing a bobbin with a sufficient supply of lower thread thereon, from another bobbin stock position of the bobbin stock section. Then, the bobbin grasping device is moved, via the transfer mechanism, to the rotary hook with the taken-out new bobbin case held by the device and places the new bobbin case in the empty rotary hook. Bobbin changing operation is automatically carried out generally in accordance with such an operational sequence.

With the bobbin changer of the type disclosed in Patent Literature 2, the human operator only has to perform operation for retrieving an empty bobbin case from the bobbin stock section provided adjacent to the front end edge of the sewing table (machine table) and replenishing or resupplying the bobbin stock section with a new bobbin case containing a bobbin having a sufficient supply of lower thread thereon. Thus, the bobbin changer disclosed in Patent Literature 2 allows the human operator to perform the necessary operation with considerable ease. On the other hand, with the bobbin changer disclosed in Patent Literature 1, where no transfer mechanism is used and the bobbin stock section is disposed near the rotary hook, the human operator itself has to manually change a bobbin case in the rotary hook on the rotary hook base by getting under the sewing table, which is very troublesome operation. Thus, in large-size industrial sewing machines (not only ordinary industrial sewing machines but also embroidery sewing machines), the bobbin changer of the type disclosed in Patent Literature 2 is becoming essential in order to enhance the efficiency of a sewing operation. However, the conventionally-known bobbin changers have much room for improvement, and, in fact, such improvement has been hoped for over the years.

In the bobbin changer disclosed in Patent Literature 2, for example, a guide plate for guiding the movement of the bobbin grasping device has a linear first guide groove, and a second groove having orientation-changing slanted portions near the opposite ends thereof. By being guided by the orientation-changing slanted portions of the second groove, the orientation of a chuck section of the bobbin grasping device can be changed at each end of a transfer stroke of the grasping device. Namely, the transfer mechanism (i.e., guide plate) has integrally incorporated therein a mechanism for changing the orientation of the chuck section at the opposite ends of the transfer stroke.

As well known in the art, the sewing machines come in variety of sizes depending on, for example, the range to be embroidered, and the distance from the rotary hook bases to the front end edge of the sewing table, i.e. from the rotary hooks to the bobbin stock sections, also differs depending on the size of the sewing machine. Thus, guide plates of various types (sizes) would be required which correspond to different distances from the rotary hooks to the bobbin stock sections. With the aforementioned conventional technique (disclosed in Patent Literature 2), where the guide plate has integrally incorporated therein the mechanisms for changing the orientation of the chuck section at the opposite ends of the transfer stroke, it is necessary to separately make such guide plates (having integrally incorporated therein the mechanisms for changing the orientation of the chuck section at the opposite ends of the transfer stroke) in various sizes and constructions suited for various types of sewing machines, which tends to take a lot of time and labor in manufacturing of component parts and therefore results in high cost.

In view of the aforementioned prior art problems, WO2005/047586 (hereinafter referred to as "Patent Literature 3") discloses a more sophisticated bobbin changer apparatus which includes: a first orientation change mechanism for, during transfer by a transfer mechanism of a bobbin grasping device toward a rotary hook, changing the orientation of a chuck section of the bobbin grasping device so that the chuck section faces toward the rotary hook; and a second orientation change mechanism for, during transfer by the transfer mechanism of the bobbin grasping device toward a bobbin stock section, changing the orientation of the chuck section of the bobbin grasping device so that the chuck section faces toward the bobbin stock section. In the bobbin changer apparatus disclosed in Patent Literature 3, the first and second orientation change mechanisms are detachable from the transfer mechanism.

However, in each of the bobbin changers disclosed in Patent Literature 2 and Patent Literature 3, where the first and second orientation change mechanisms for orientating the chuck section of the bobbin grasping device toward the rotary hook and bobbin stock section, respectively, are provided separately, there would arise the problems that the overall construction of the bobbin changer apparatus becomes complicated and the number of necessary components increases.

Further, because air actuators are used as driving devices for the transfer operation of the transfer mechanism and opening/closing operation of the chuck section of the bobbin grasping device in the conventionally-known bobbin changer apparatus, the drive mechanisms would become extremely complicated in construction and require high cost. Furthermore, in the case where the bobbin changer apparatus is applied to a multi-head sewing machine equipped with a plurality of machine heads, it is difficult to perform control for changing a bobbin of a particular one of a plurality of rotary hooks, because one common drive source is shared among the bobbin changer apparatus corresponding to the rotary hooks.

Furthermore, in the conventionally-known bobbin changer apparatus, there have been taken no appropriate measures against errors in bobbin changing operation. In addition, the conventionally-known bobbin changer apparatus are not constructed to allow a lower thread color change to be effected as desired in the course of sewing of a given sewing pattern.

SUMMARY OF THE INVENTION

In view of the foregoing, it is an object of the present invention to simplify the construction of an orientation change mechanism in a bobbin changer apparatus of a type which transfers a bobbin case, containing a lower thread bobbin, between a rotary hook of a sewing machine and a bobbin stock section, provided on a machine table adjacent to the front end edge of the machine table remotely from the rotary hook, to thereby change the lower thread bobbin.

It is another object of the present invention to provide a bobbin changer apparatus which has drive mechanisms of a simplified construction and which can selectively change a bobbin only in a particular rotary hook with utmost ease.

It is still another object of the present invention to provide a sewing machine which is arranged to take appropriate anti-error measures and permits reliable delivery/receipt of a bobbin case.

It is still another object of the present invention to provide a sewing machine which allows a lower thread color change to be effected as desired in the course of a sewing operation.

According to one aspect of the present invention, there is provided an improved bobbin changer apparatus for changing a lower thread bobbin mounted in a rotary hook of a sewing machine by acquiring a replacement bobbin case, containing a lower thread bobbin, from a bobbin stock section provided apart from the rotary hook, which comprises: a bobbin grasping device for grasping a bobbin case at a distal end portion of a chuck section; a transfer mechanism for reciprocatively transferring the bobbin grasping device between the rotary hook and the bobbin stock section; and an orientation change mechanism for, in a position near one end of a stroke of transfer by the transfer mechanism of the bobbin grasping device (i.e., transfer stroke of the bobbin grasping device), changing an orientation of the chuck section of the bobbin grasping device, being transferred toward the rotary hook, so that the chuck section faces toward the rotary hook, and changing the orientation of the chuck section of the bobbin grasping device, being transferred toward the bobbin stock section, so that the chuck section faces toward the bobbin stock section.

According to the preset invention, the orientation of the chuck section of the bobbin grasping device can be changed, via the single orientation change mechanism, near the one end of the transfer stroke of the bobbin grasping device, in two directions, i.e. in the direction toward the rotary hook and in the direction toward the bobbin stock section; thus, the preset invention can provide a simplified orientation changing construction with a reduced number of component parts. Further, even if the distance between the rotary hook and the bobbin stock section, i.e. transfer distance (over which the bobbin grasping device is transferred), changes depending on the type of the sewing machine, it is possible to readily deal with such a change in the distance between the rotary hook and the bobbin stock section.

According to another aspect of the present invention, there is provided an improved bobbin changer apparatus for changing a lower thread bobbin mounted in a rotary hook of a sewing machine by acquiring a replacement bobbin case, containing a lower thread bobbin, from a bobbin stock section provided on a machine table adjacent to the front end edge of the machine table remotely from the rotary hook, which comprises: a bobbin grasping device for grasping a bobbin case at a distal end portion of a chuck section; a transfer mechanism for reciprocatively transferring the bobbin grasping device between the bobbin stock section and the rotary hook; and an orientation-changing motor mounted, on the bobbin grasping device, for pivoting the chuck section to thereby selectively cause the chuck section to face toward the rotary hook and cause the chuck section to face toward the bobbin stock section.

By the orientation-changing motor mounted on the bobbin grasping device, the orientation of the chuck section can be changed in two directions, i.e. in the direction toward the rotary hook and in the direction toward the bobbin stock section; thus, the preset invention can provide a simplified orientation changing construction with a reduced number of component parts. Further, even if the distance between the rotary hook and the bobbin stock section, i.e. transfer distance (over which the bobbin grasping device is transferred), changes depending on the type of the sewing machine, it is possible to readily deal with such a change in the distance between the rotary hook and the bobbin stock section.

In a preferred embodiment, as an actuator for selectively performing a grasp operation for causing the chuck section in an empty state to grasp a bobbin case and a release operation for releasing a bobbin case from the chuck section, a driving motor of the transfer mechanism is provided independently for each of the rotary hooks to which a plurality of the bobbin changer apparatus correspond. Further, in the case where the bobbin stock section is provided for each of the rotary hooks, the bobbin stock section provided for each of the rotary hooks may include: a plurality of bobbin holding portions; a selection mechanism for selectively positioning any one of the bobbin holding portions at a predetermined bobbin changing position; and an independent motor for driving the selection mechanism. Thus, as compared to the conventional bobbin changer apparatus where air cylinders are driven by a common air power supply, the present invention can significantly simplify the construction of the drive mechanisms. Further, with the independent motors employed for the individual rotary hooks, it is possible implement a bobbin change (replacement) only for a particular one of the rotary hooks.

According to still another aspect of the present invention, there is provided an improved sewing machine, which comprises: a bobbin stock section for holding replacement bobbin cases, the bobbin stock section including: a plurality of bobbin holding portions; a selection mechanism for selectively positioning any one of the bobbin holding portions at a predetermined bobbin changing position; and a detection section for detecting whether or not a bobbin case is currently held by the bobbin holding portion positioned at the predetermined bobbin changing position; a bobbin changer apparatus for changing a lower thread bobbin mounted in a rotary hook of the sewing machine, the bobbin changer apparatus including a bobbin grasping device for grasping a bobbin case at a distal end portion of a chuck section, and a transfer mechanism for reciprocatively transferring the bobbin grasping device between the rotary hook and the bobbin stock section; a control section for halting transfer, by the transfer mechanism, of the bobbin grasping device toward the bobbin stock section once the detection section detects that a bobbin case is currently held by the bobbin holding portion positioned at the predetermined bobbin changing position when the bobbin case grasped by the bobbin grasping device is to be passed to the bobbin holding portion positioned at the predetermined bobbin changing position, and for halting transfer, by the transfer mechanism, of the bobbin grasping device toward the bobbin stock section once the detection section detects that no bobbin case is currently held by the bobbin holding portion positioned at the predetermined bobbin changing position when the bobbin grasping device is transferred toward the bobbin holding portion positioned at the predetermined bobbin changing position in order to receive a bobbin case from the bobbin holding portion positioned at the predetermined bobbin changing position.

Namely, in the bobbin stock section, the detection section is provided for detecting whether or not a bobbin case is currently held by the bobbin holding portion positioned at the predetermined bobbin changing position, and, in accordance with a result of the detection by the detection section, the control section performs control for halting the transfer, by the transfer mechanism, of the bobbin grasping device toward the bobbin stock section. Such arrangements can prevent a mechanical damage from occurring by the bobbin grasping device being transferred to pass a bobbin case to the bobbin holding portion positioned at the predetermined bobbin changing position when another bobbin case is currently held by the bobbin holding portion positioned at the predetermined bobbin changing position, thereby reliably preventing erroneous operation. The above-described arrangements of the invention can also prevent the possibility that, although no bobbin case is currently held at the predetermined bobbin changing position, the bobbin grasping device may be transferred to the predetermined bobbin changing position in order to receive a bobbin case from the predetermined bobbin changing position and then returned to the rotary hook with no replacement bobbin case grasped thereby. In this way, the bobbin changer apparatus can be controlled to perform reliable delivery/receipt of bobbin cases, i.e. exchange of bobbin cases between the bobbin stock section and the rotary hook.

According to still another aspect of the present invention, there is provided an improved sewing machine for performing sewing with an upper thread passed through a sewing needle and a lower thread paid out from a bobbin mounted in a rotary book, which comprises: a bobbin stock section holding at least two bobbin cases containing lower threads of different characteristics, the bobbin stock section positioning a selected one of the bobbin cases at a predetermined bobbin changing position; a bobbin grasping device having a chuck section for grasping a bobbin case; a transfer mechanism for transferring the bobbin grasping device between the bobbin stock section and the rotary hook; and a lower thread change control section for, in response to a lower thread change signal, performing control such that a bobbin case is taken out from the rotary hook by the bobbin grasping device, the bobbin grasping device with the bobbin case taken out from the rotary hook is transferred, by the transfer mechanism, to the bobbin stock section, a new bobbin case is positioned at the predetermined bobbin changing position of the bobbin stock section, the new bobbin case is grasped by the bobbin grasping device and then the bobbin grasping device with the new bobbin case grasped thereby is transferred, by the transfer mechanism, to the rotary hook.

In the sewing machine thus arranged, the bobbin case set in the rotary hook can be changed with a new bobbin case in response to a lower thread change signal; thus, a bobbin case containing a lower thread of a suitable characteristic corresponding to the lower thread change signal can be set into the rotary hook as needed, which allows a lower thread change to be implemented as desired in the course of a sewing operation.

According to still another aspect of the present invention, there is provided an improved sewing machine for performing sewing with an upper thread passed through a sewing needle and a lower thread paid out from a bobbin mounted in a rotary book, which comprises: a bobbin stock section holding at least two bobbin cases containing lower threads, the bobbin stock section positioning a selected one of the bobbin cases at a predetermined bobbin changing position; a bobbin grasping device having a chuck section for grasping a bobbin case; and a transfer mechanism for transferring the bobbin grasping device between the bobbin stock section and the rotary hook, the bobbin stock section including: a bobbin holder unit having a plurality of bobbin holding portions each for holding a bobbin case; and a mechanism having a moving member, the mechanism detachably attaching the bobbin holder unit to the moving member and positioning one of the bobbin holding portions of the attached bobbin holder unit at the predetermined bobbin changing position by moving the moving member.

With such a sewing machine, where the bobbin holder unit having a plurality of bobbin holding portions is detachably attached to the moving member, a plurality of bobbin cases can be set onto the bobbin stock section collectively in a short time, so that the operating efficiency can be significantly enhanced.

According to still another aspect of the present invention, there is provided an improved bobbin changer apparatus for changing a lower thread bobbin mounted in a rotary hook by acquiring a replacement bobbin case, containing a lower thread bobbin, from a bobbin stock section, which comprises: a bobbin grasping device for grasping a bobbin case at a distal end portion of a chuck section; and a transfer mechanism for reciprocatively transferring the bobbin grasping device between the rotary hook and the bobbin stock section, the bobbin grasping device including: the chuck section for selectively performing a grasp operation for grasping a bobbin case and a release operation for releasing a bobbin case; a support section for supporting the chuck section in such a manner that the chuck section is slidable within a predetermined range, the support section being transferable by the transfer mechanism; and a spring member for normally biasing the chuck section, supported by the support section, toward a bobbin case, the chuck section being slidable relative to the support section within the predetermined range in accordance with resiliency of the spring member.

Because the chuck section, supported by the support section, is normally biased, by the spring member, toward the bobbin case, the chuck section can be resiliently pressed against the bobbin case when the bobbin case is difficult to grasp, so that the bobbin case can be reliably grasped by the chuck section. When the bobbin case is passed to (i.e., released toward) the rotary hook or bobbin stock section, on the other hand, even if the support section is moved, by the transfer mechanism, away from the rotary hook or bobbin stock section after having released the bobbin case, the bobbin case can be reliably passed to the rotary hook or bobbin stock section because the chuck section keeps pressing the bobbin case for some time (i.e., over the predetermined range the chuck section slides relative to the support section).

According to still another aspect of the present invention, there is provided an improved sewing machine including a plurality of machine heads and a bobbin stock section and bobbin changer apparatus provided for each of rotary hooks corresponding to the machine heads, each of the bobbin changer apparatus changing a lower thread bobbin mounted in the rotary hook by acquiring a replacement bobbin case, containing a lower thread bobbin, from the bobbin stock section corresponding thereto, each of the bobbin changer apparatus including: a mode selection switch operable to select a bobbin changing operation mode; a switch operable to instruct execution of a bobbin changing operation in accordance with the bobbin changing operation mode selected via the mode selection switch; and a display for displaying a state of the bobbin changer apparatus.

With the provision of the mode selection switch, bobbin-changing-operation execution instructing switch and state displaying display, a human operator can instruct a necessary mode selection, bobbin changing operation, etc. after having checked via the display a current state of the bobbin changer apparatus, and thus, an enhanced operability can be achieved.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

Figure 12:
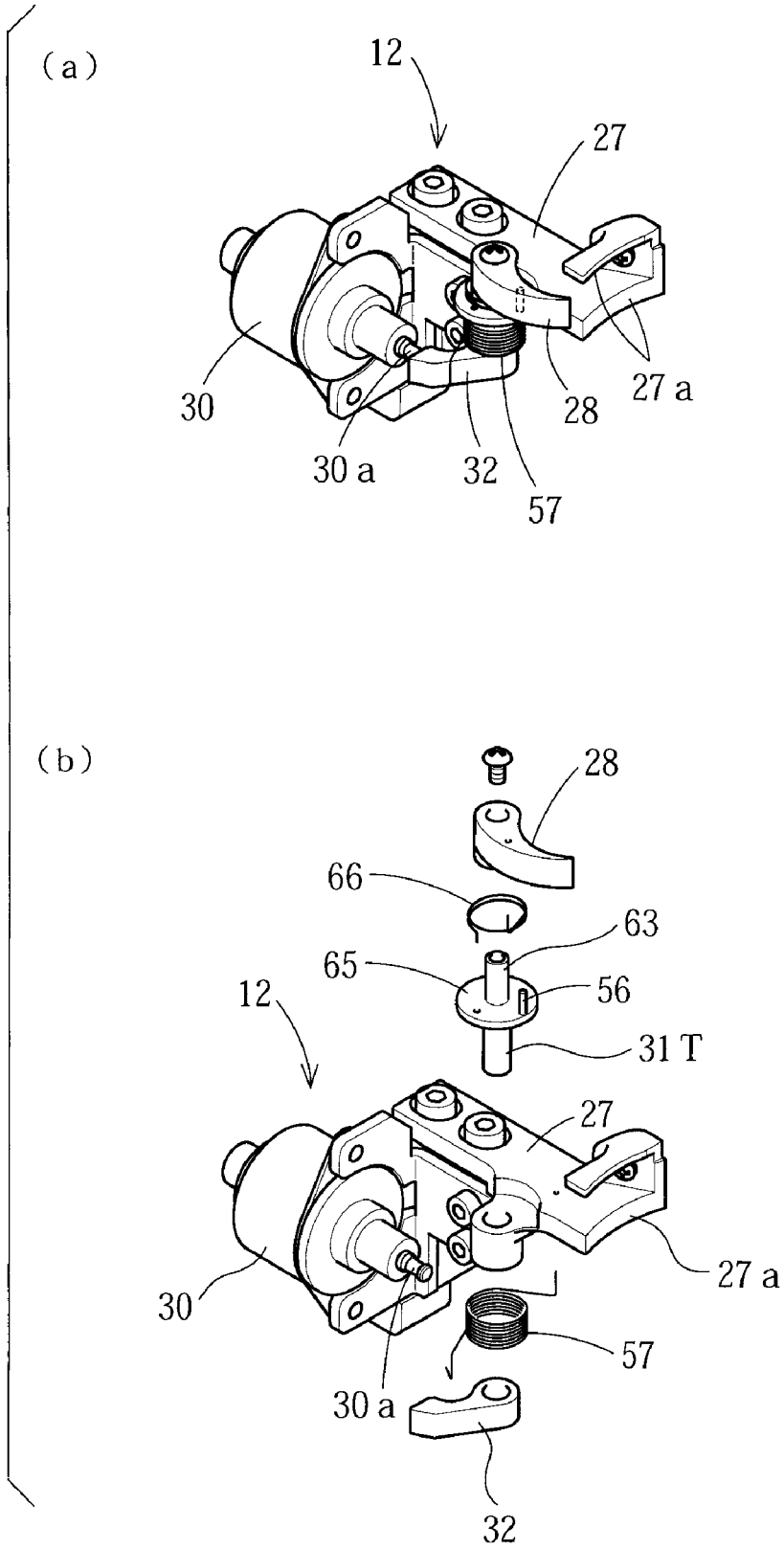
Figure 13:
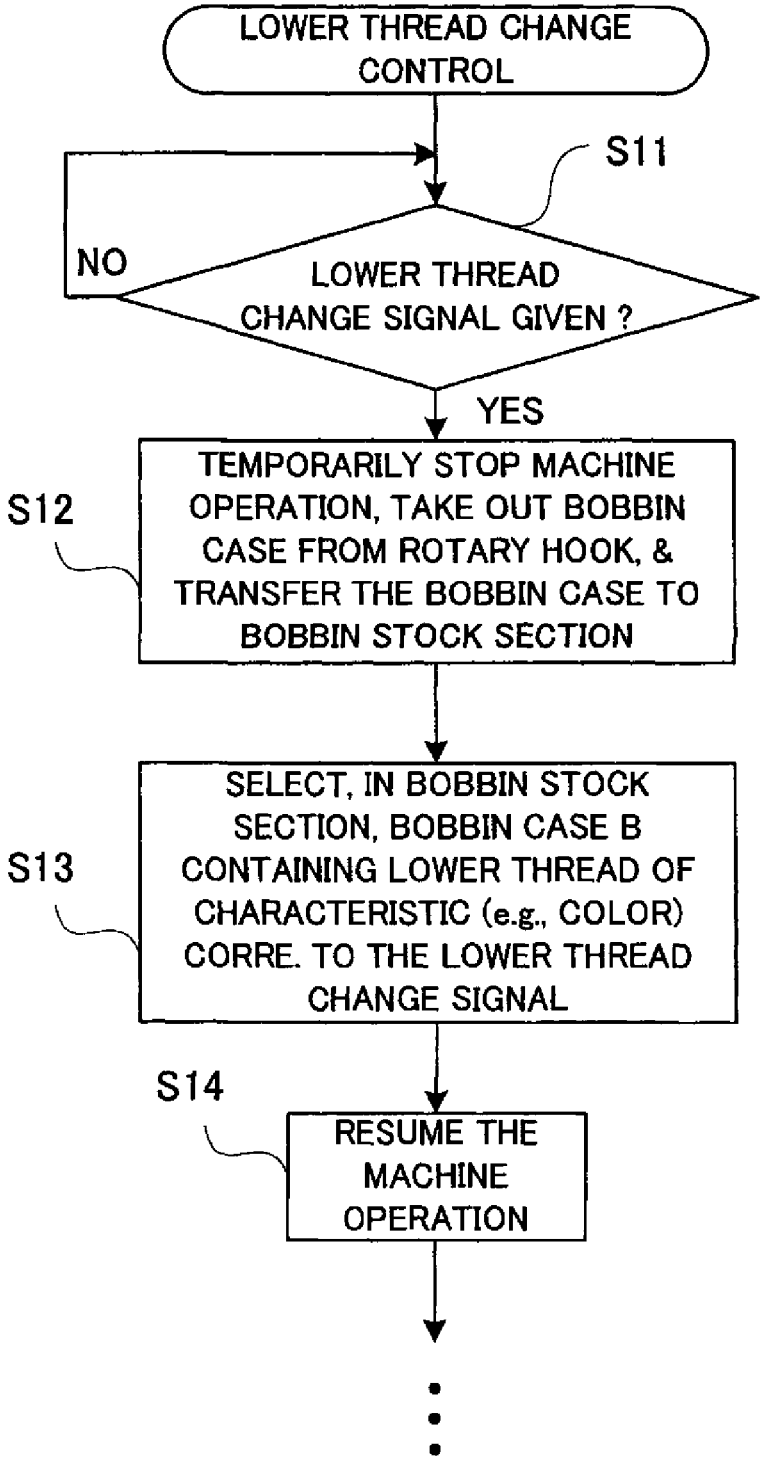
Figure 14:
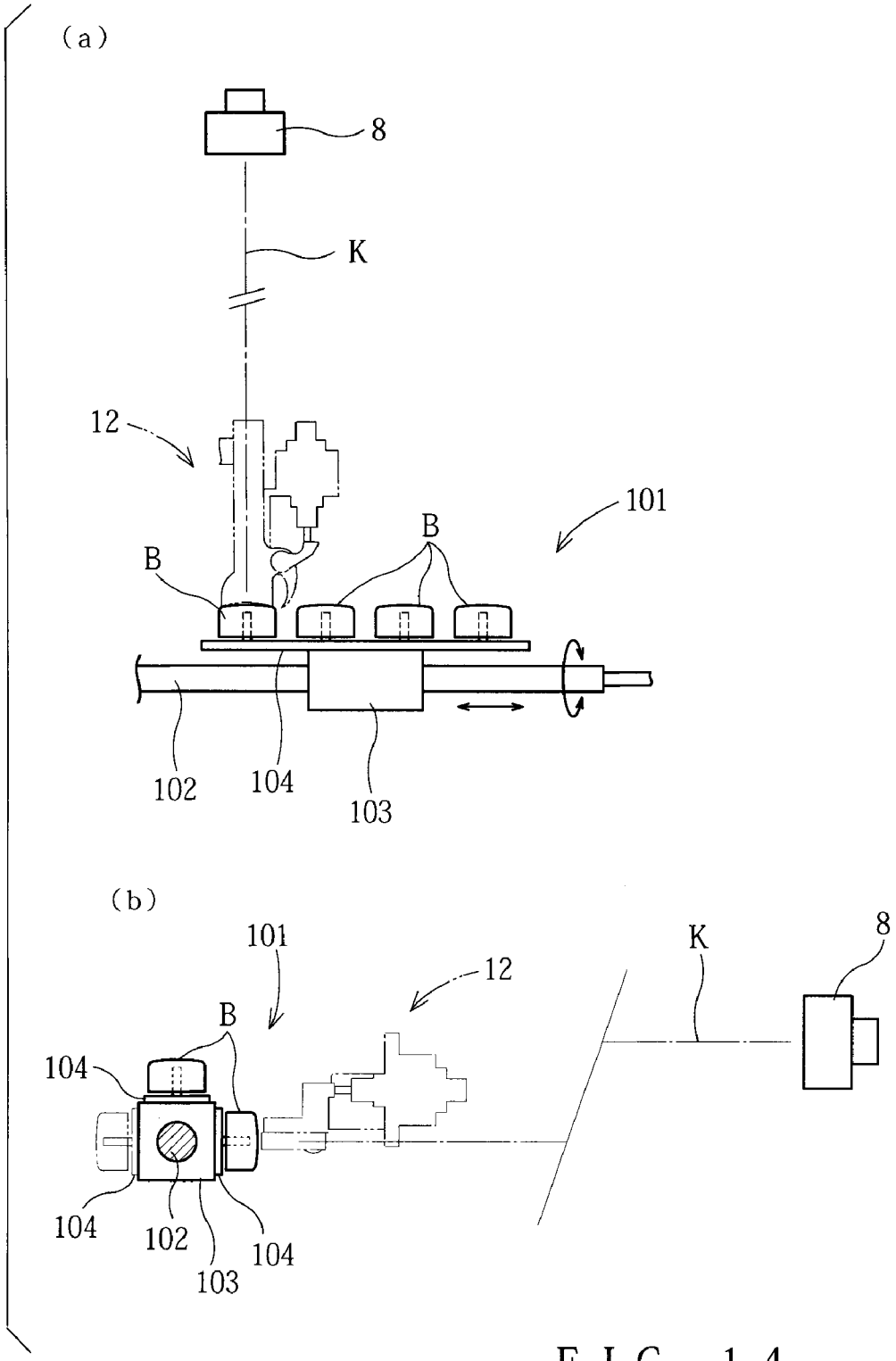
Figure 15:
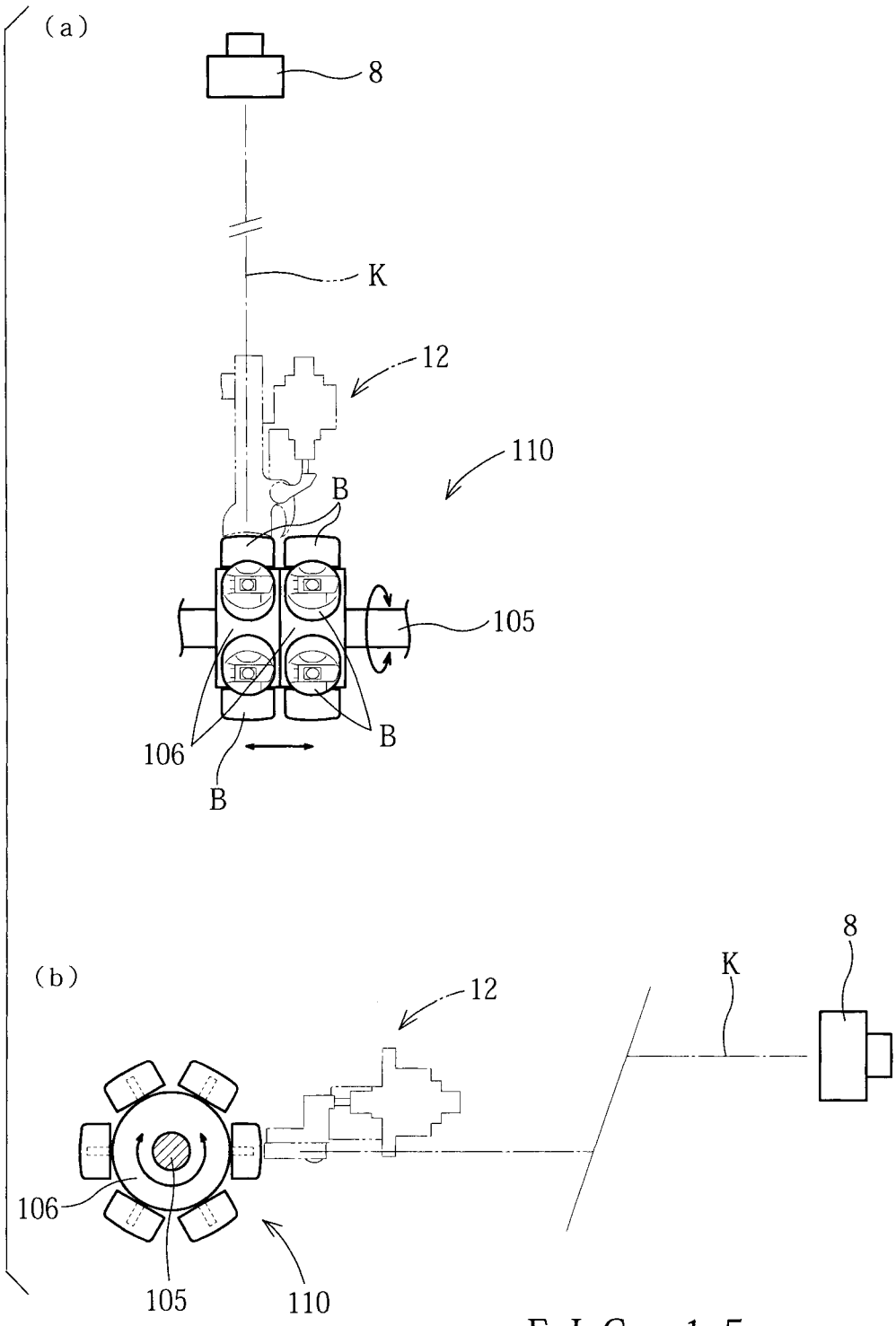
Figure 16:
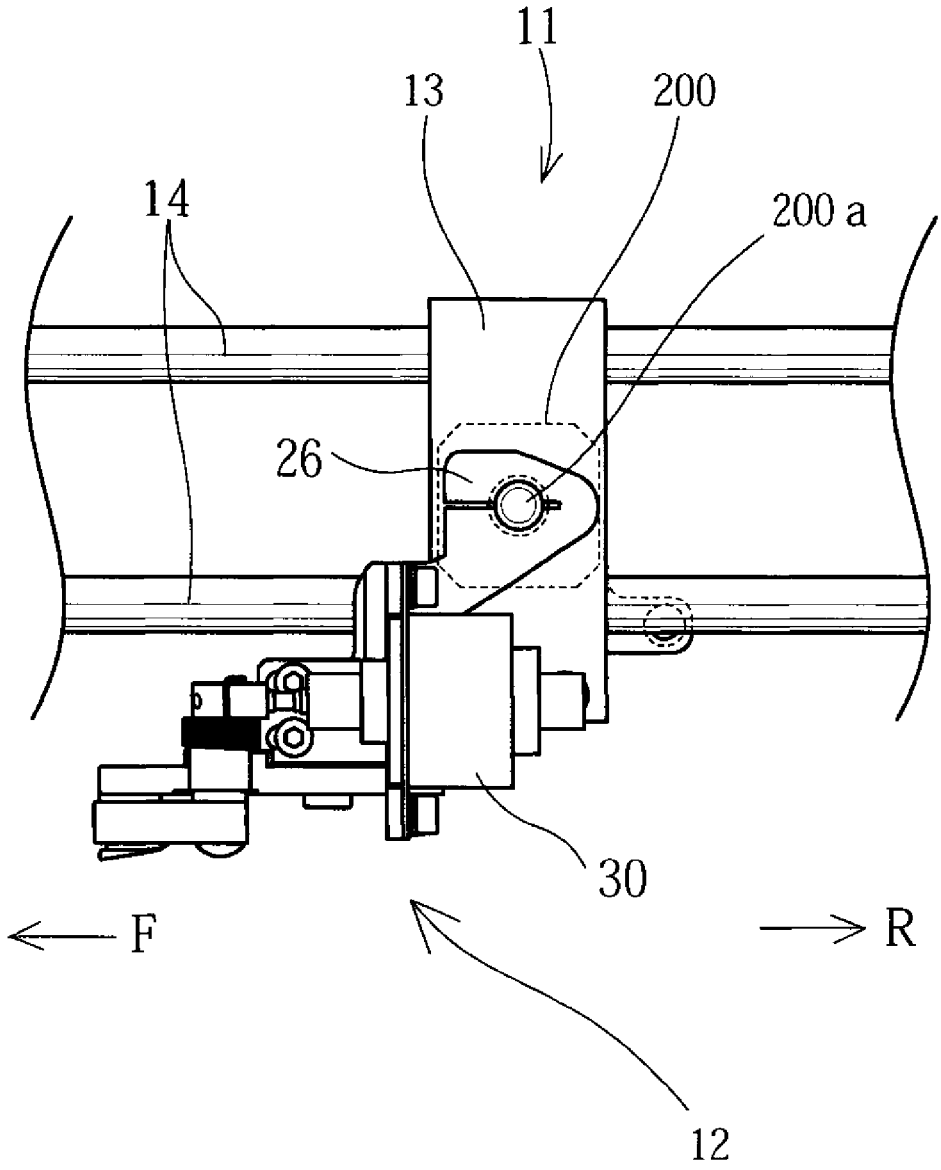
Figure 17:
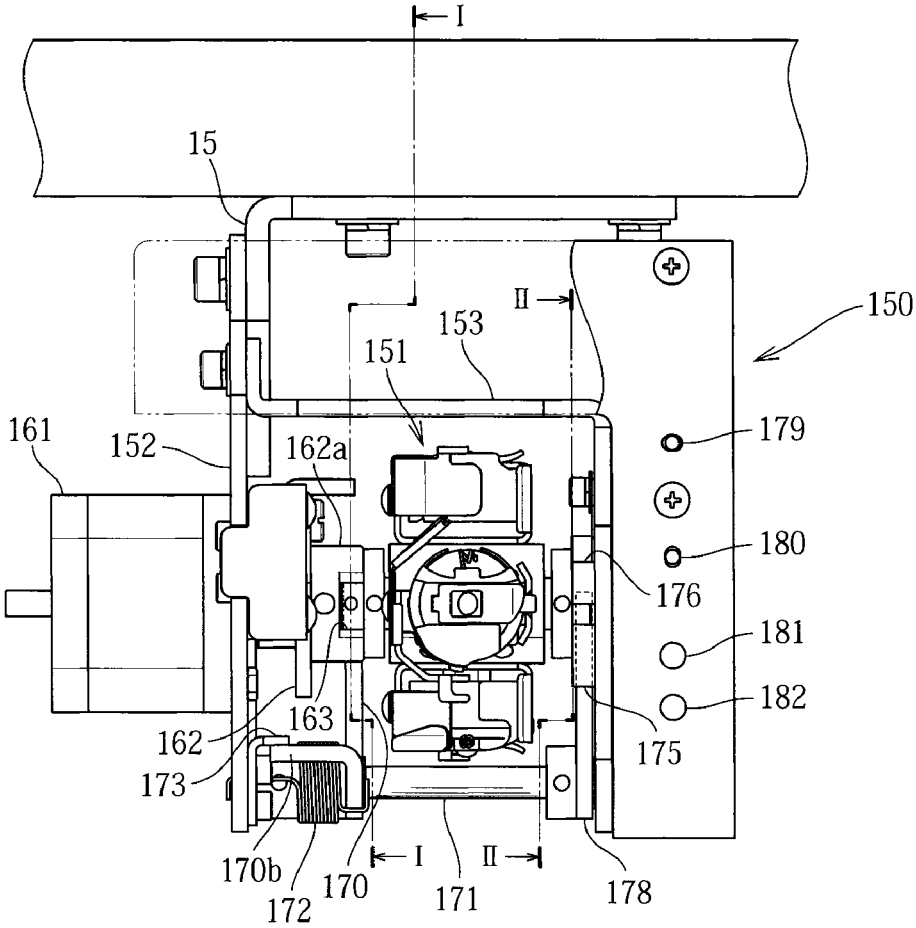
Figure 18:
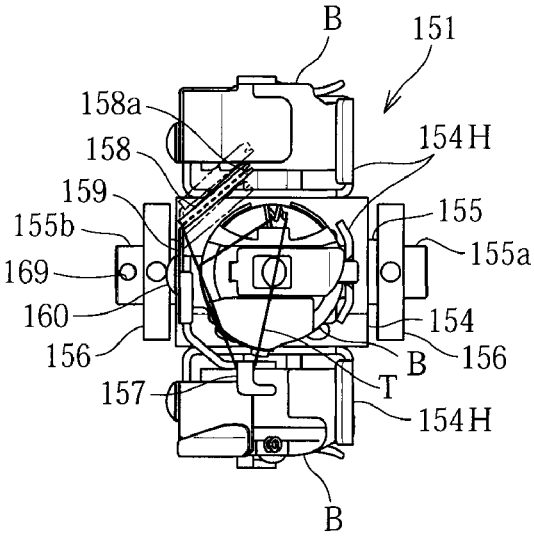
Figure 19:
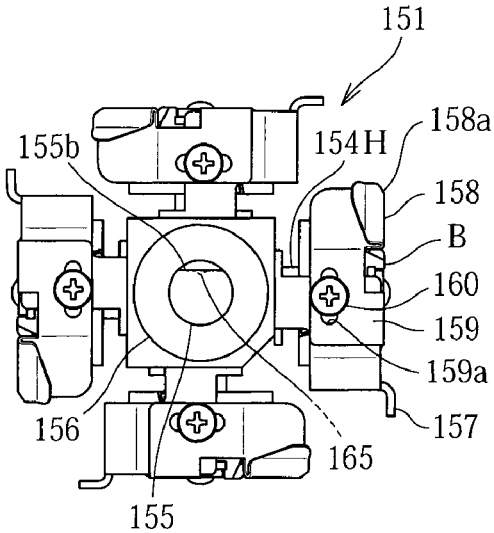
Figure 20:
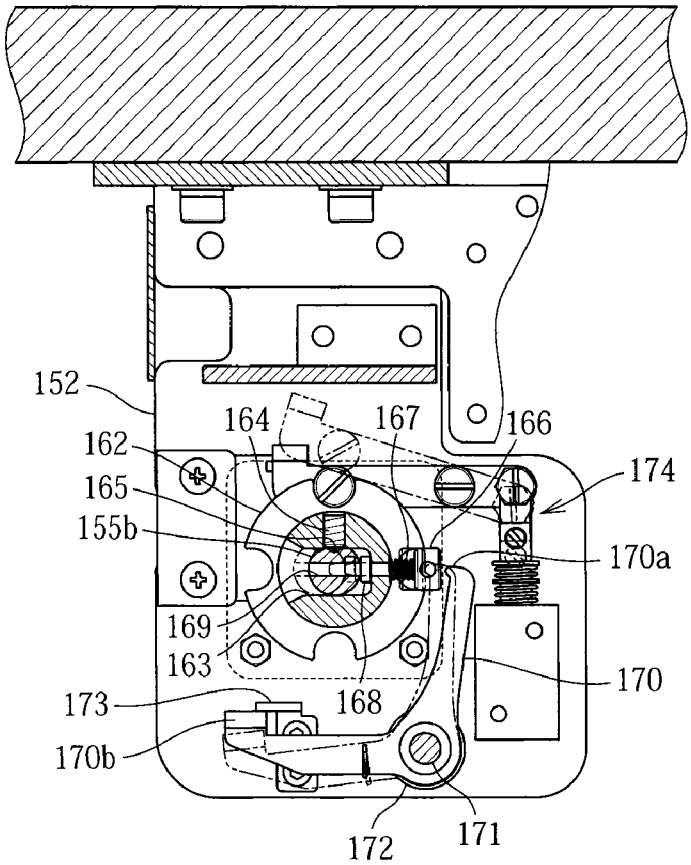
Figure 21:
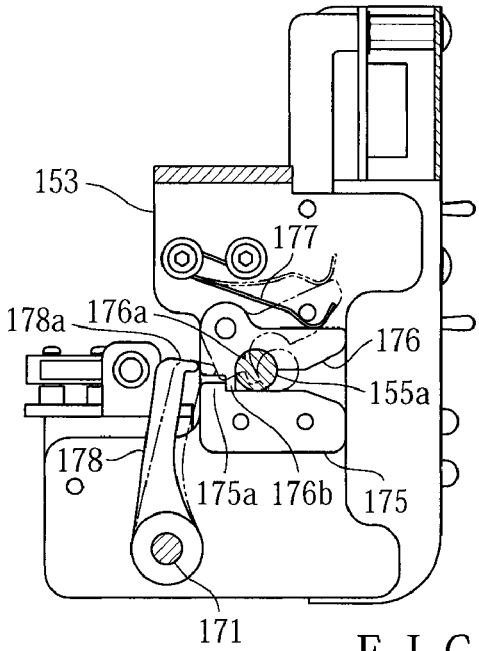
Figure 22:
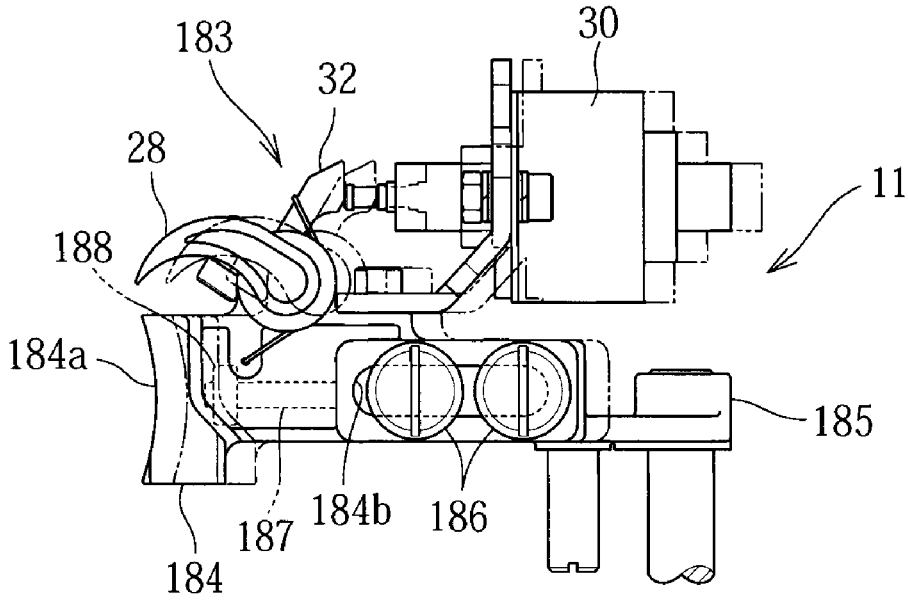
Figure 23:
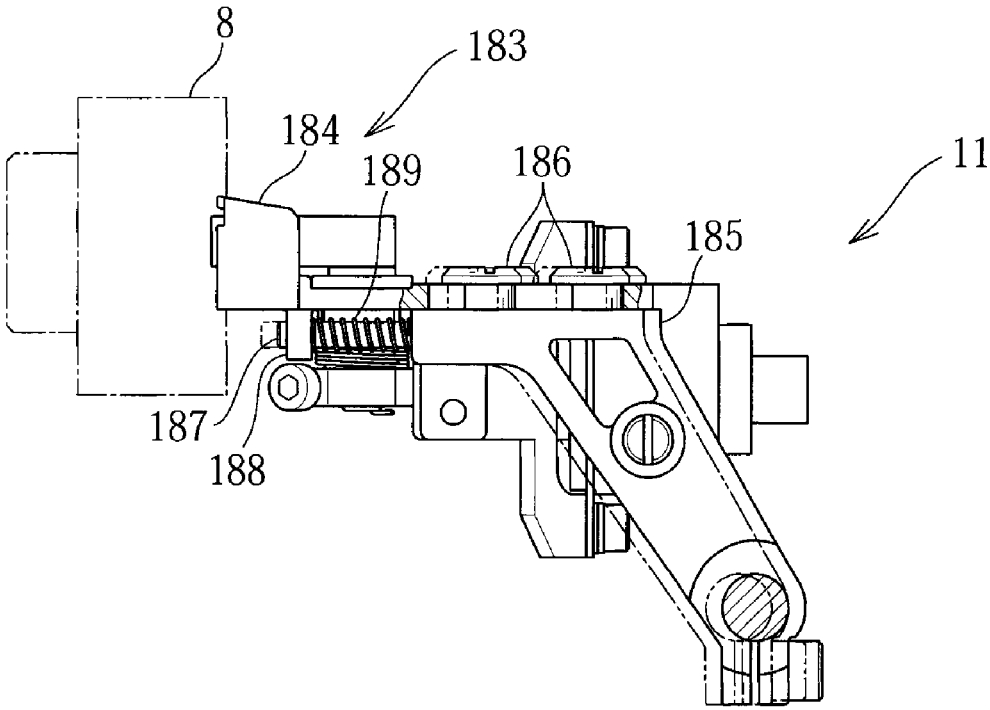

(a) of FIG. 12 is a perspective view showing a modification of the chuck device, and (b) of FIG. 12 is an exploded perspective view showing the modification of the chuck device;

FIG. 13 is a flow chart showing an example operational sequence of a "lower thread change control" routine performed in the course of an embroidery sewing operation based on selected embroidery sewing pattern data;

(a) of FIG. 14 is a schematic plan view showing a modified bobbin stock section, and (b) of FIG. 14 is a right side view of the modified bobbin stock section;

(a) of FIG. 15 is a schematic plan view showing another modified bobbin stock section, and (b) of FIG. 15 is a right side view of the other modified bobbin stock section;

FIG. 16 is a side view of a bobbin changer apparatus in accordance with another embodiment of the present invention;

FIG. 17 is a front view of another embodiment of the bobbin stock section;

FIG. 18 is a front view of a bobbin holder unit as detached from the bobbin stock section of FIG. 17;

FIG. 19 is a left side view of the bobbin holder unit shown in FIG. 18;

FIG. 20 is a sectional view taken along the I-I line of FIG. 17;

FIG. 21 is a sectional view taken along the II-II line of FIG. 17;

FIG. 22 is a bottom view showing another embodiment of the chuck device; and FIG. 23 is a side view of the chuck device shown in FIG. 22.

DETAILED DESCRIPTION OF THE INVENTION

Figure 1:
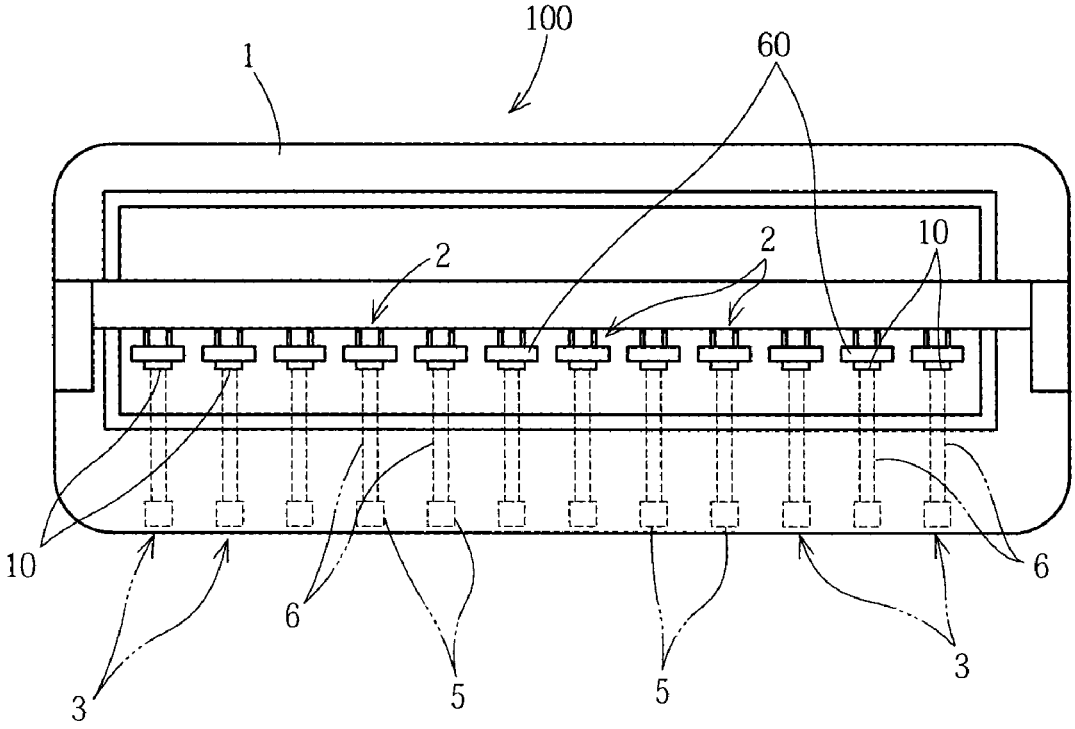
FIG. 1 is a schematic plan view showing an example of a multi-head, multi-needle embroidery sewing machine employing a bobbin changer apparatus in accordance with an embodiment of the present invention.

FIG. 1 is a schematic view showing a multi-head, multi-needle embroidery sewing machine 100 employing a bobbin changer apparatus in accordance with an embodiment of the present invention. Similarly to the conventionally-known counterparts, the multi-head, multi-needle embroidery sewing machine 100 includes a plurality of machine heads 2, and a needle bar case 60 containing a plurality of needle bars is provided in each of the machine heads 2. As in the conventionally-known counterparts, needle plates are disposed on a machine table 1 in corresponding relation to the machine heads 2, a rotary hook base 7 (FIG. 2) is provided beneath each of the needle plates 1, and a rotary hook 8 (FIG. 2) is supported on each of the rotary hook bases 7. Bobbin stock sections 5 are provided, on the underside of a front end portion of the machine table 1, in corresponding to the rotary hooks 8. There is some distance from the machine heads 2 and rotary hooks 8 to the front end edge of the machine table 1, and thus, each of the bobbin stock sections 5 is spaced apart by a distance, corresponding to the above-mentioned distance, from the corresponding rotary hook 8. On the underside of the machine table 1, bobbin changer apparatus 3 are provided in corresponding relation to the machine heads 2. Each of the bobbin changer apparatus 3 is arranged to change or replace a lower thread bobbin mounted in the rotary hook 8, by exchanging bobbin cases, each containing a lower thread bobbin, between the rotary hook 8 and the bobbin stock section 5, and the bobbin changer apparatus 3 includes a transfer section (transfer mechanism) 6 extending between the rotary hook 8 and the bobbin stock section 5.

[Overall Description about the Bobbin Changer Apparatus]

Figure 2:
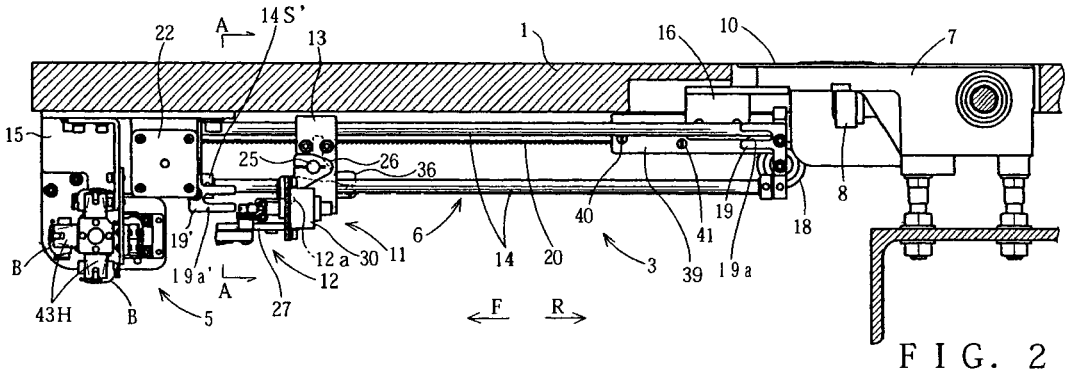
FIG. 2 is a right side view showing the bobbin changer apparatus, rotary hook base and bobbin stock section shown in FIG. 1.
Figure 3:
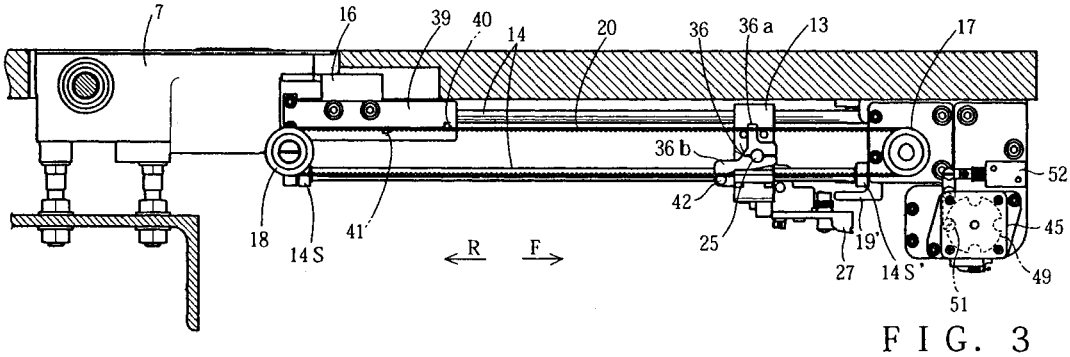
FIG. 3 is a left side view showing the bobbin changer apparatus, rotary hook base and bobbin stock section shown in FIG. 1.
Figure 4:
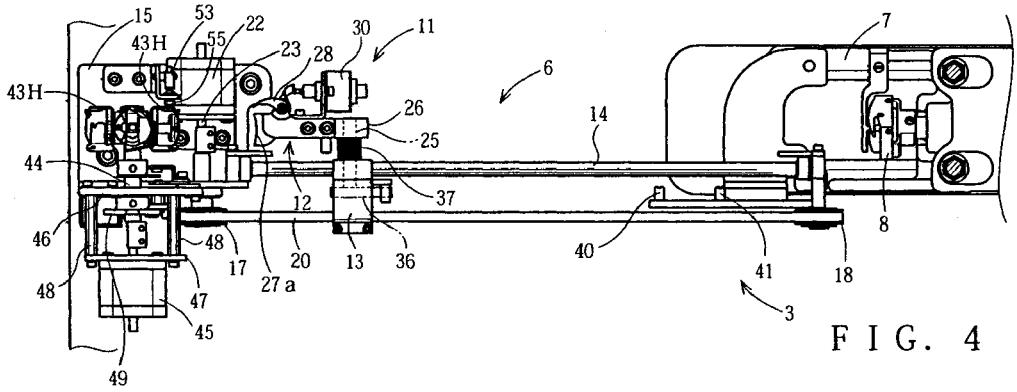
FIG. 4 is a bottom view showing the bobbin changer apparatus, rotary hook base and bobbin stock section shown in FIG. 1.
Figure 5:
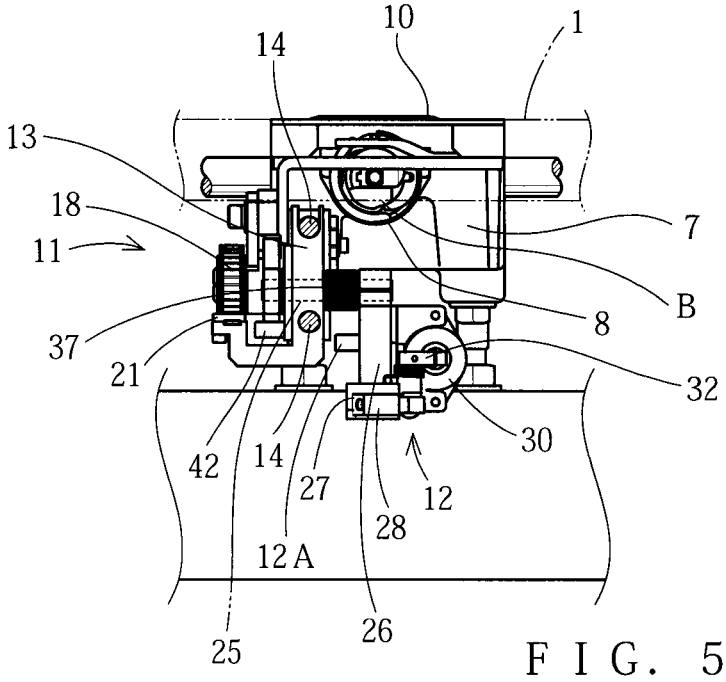
FIG. 5 is a sectional view taken along the A-A line of FIG. 2.

The following paragraphs describe the embodiment of the bobbin changer apparatus 3, with reference to FIGS. 2-5. FIGS. 2, 3 and 4 are a right side view, left side view and bottom view, respectively, of the bobbin changer apparatus 3, rotary hook base 7 and bobbin stock section 5, and FIG. 5 is a sectional view taken along the A-A line of FIG. 2.

As shown in FIG. 2, the bobbin changer apparatus 3 includes a bobbin grasping device 11 for grasping and transferring a bobbin case B, the above-mentioned transfer section 6 for transferring the bobbin grasping device 11 between the rotary hook 8 and the bobbin stock section 5, and an orientation change mechanism (i.e., section denoted at 39, 40 and 41) for changing the orientation of the bobbin grasping device 11 during transfer, by the transfer section 6, of the bobbin grasping device 11. The bobbin grasping device 11 includes a chuck device 12 for grasping a bobbin case B at its distal end portion, and a moving member 13 pivotally supporting the chuck device 12.

The transfer section 6 includes a pair of upper and lower guide bars 14 extending horizontally between the rotary hook 8 and the bobbin stock section 5, and the moving member 13 of the bobbin grasping device 11 is slidably supported on the two guide bars 14. Each of the guide bars 14 is disposed between a first bracket 15 via which the bobbin changer apparatus 3 is fixed to the underside of the machine table 1 and a second bracket 16 fixed to the rotary hook base 7. Further, the guide bars 14 are disposed substantially in parallel to the machine table 1 and removably attached by means of mounting screws.

As shown in FIG. 3, a driving pulley 17 and driven pulley 18 are supported on the first bracket 15 and second bracket 16, respectively, and a timing belt 20 is wound on and extends between the driving pulley 17 and the driven pulley 18. Lower straight traveling portion of the timing belt 20 extends along a side of the lower guide bar 14, and a lower portion of the moving member 13 is coupled to the lower straight traveling portion by means of a coupling member 21.

As seen in FIG. 4, the driving pulley 17 is connected to a motor shaft 23 of a motor 22 fixed to the first bracket 15, and the moving member 13 is driven, by forward and reverse driving of the motor 22, to move in a front-rear direction of the sewing machine; thus, the bobbin grasping device 11 provided with the chuck device 12 is transferred between the rotary hook 8 and the bobbin stock section 5. Note that the transferring motor 22 is provided separately for each of the bobbin changer apparatus 3 corresponding to the rotary hooks 8. Therefore, as compared to the conventional bobbin changer apparatus where air cylinders are driven by a common air power supply, the instant embodiment can significantly simplify the construction of the drive mechanisms. Further, with the independent motor provided for each of the rotary hooks, it is possible to drive only the transfer section 6 corresponding to a particular one of the machine heads, so that a bobbin case change can be implemented easily only for the rotary hook.

As shown in FIGS. 2 and 5, a support shaft 25 extending horizontally at a right angle to the guide bars 14 is rotatably supported on the moving member 13 of the bobbin grasping device 11. Support arm 26 is fixed to one projecting end of the support shaft 25, and the chuck device 12 is supported on the support arm 26. In this manner, the chuck device 12 is pivotally supported by the moving member 13.

[Detailed Description about the Chuck Device of the Bobbin Changer Apparatus]

Figure 6:
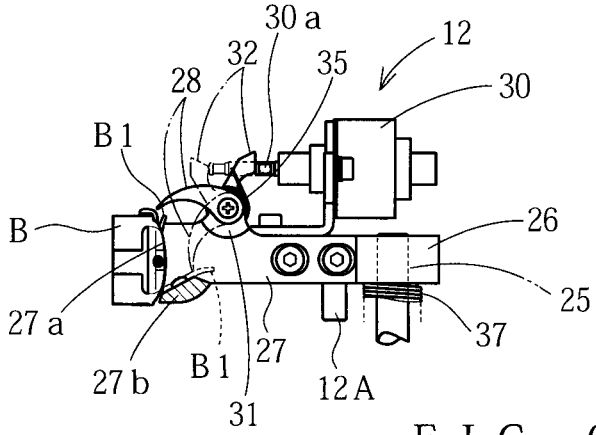
FIG. 6 is an enlarged bottom view of a chuck device in the bobbin changer apparatus.

First, with reference to FIG. 6 as well as FIGS. 2, 4 and 5, a description will be given about details of the chuck device 12. FIG. 6 is an enlarged bottom view of the chuck device 12, which also shows a bobbin case B in order to explain behavior of the chuck device 12 when grasping the bobbin case B. The chuck device 12 includes a holding member 27 for catching and holding a bobbin case B, a claw 28 for pulling out a knob B1 of the bobbin case B, and a linear motor 30 for opening and closing the claw 28. As seen in FIG. 6, the holding member 27 has, at its distal end edge, an engagement portion 27*a* for receiving the bobbin case B, and it pivotably supports the claw 28 via a pin 31. Actuating lever 32 is coupled to the claw 28 via the pin 31, and these elements 28 and 32 can be caused to pivot together.

The linear motor 30 is mounted, via a bracket, on the support arm 26 supporting the holding member 27, and a linearly-moving rod 30*a* of the linear motor 30 has its distal end facing the actuating lever 32 so that the rod 30*a* when it is in its projecting position can push the actuating lever 32. The actuating lever 32 and claw 28 are normally biased, by a torsion spring 35, in a clockwise direction of FIG. 6 so that its free end is normally held in abutment against the distal end of the linearly-moving rod 30*a* of the linear motor 30 (as indicated by a solid line in the figure). As the linearly-moving rod 30*a* projects through activation of the linear motor 30, the actuating lever 32 is caused to pivot in the counterclockwise direction, so that the claw 28 also pivots to pull out the knob B1 of the bobbin case B. As well known, by the knob B1 of the bobbin case B being pulled out, the bobbin case B is released from retention by a bobbin case holding device, such as the rotary hook 8 or bobbin stock section 5, but also can reliably hold the bobbin therein against accidental dropping from the case B.

[Chucking Operation]

When a "grasp operation" (i.e., chucking operation) is to be performed for causing the chuck device 12 in its empty state to grasp a bobbin case B, the chuck device 12 is moved close to the bobbin case B held by the bobbin case holding device, such as the rotary hook 8 or bobbin stock section 5. Then, after the engagement portion 27*a* of the holding member 27 abuts against the front surface of the bobbin case B, the linearly-moving rod 30*a* is advanced, through activation of the linear motor 30, to a position indicated by an imaginary line in FIG. 6, so as to cause the claw 28 and actuating lever 32 as indicated by imaginary lines in FIG. 6. During that time, the knob B1 of the bobbin case B is pulled out by the pivoting movement of the claw 28. The chucking operation is completed when the knob B1 has been pressed, via the claw 28, against a receiving portion 27*b* of the holding member 27; by that time, the front surface of the bobbin case B has also been received by the engagement portion 27*a* of the holding member 27. The chuck device 12 can keep grasping the bobbin case B by the linearly-moving rod 30*a* of the linear motor 30 being maintained in the projecting state.

"release operation" for releasing the bobbin case B grasped by the chuck device 12 is performed in accordance with an operational sequence opposite to the above-mentioned operational sequence of the "grasp" operation (i.e., chucking). Namely, the chuck device 12 with the bobbin case B grasped thereby is moved close to the bobbin case holding device, such as the empty rotary hook 8 or bobbin stock section 5, and the linearly-moving rod 30*a* of the linear motor 30 is retracted to the position indicated by the solid line in FIG. 6 after the bobbin case B has been passed to the bobbin case holding device. Thus, the actuating lever 32 and claw 28 pivot in the clockwise direction from the imaginary-line positions of FIG. 6 to the solid-line positions of FIG. 6, so that the knob B1 having so far been pulled out is returned to the original or retracted position. In this manner, the bobbin case B is released from the chuck device 12.

[Construction for Orientation Change]

In the bobbin grasping device 11, as seen in FIGS. 2, 3 and 4, an actuating member (a type of cam) 36 is fixed to the other end of the support shaft 25 which projects in an opposite direction from the end of the shaft 25 having the support arm 26 (chuck device 12) mounted thereto; thus, the actuating member 36 and the chuck device 12 are pivotable together. Further, a torsion spring 37 (see FIG. 4) is fitted over the support shaft 25 between the moving member 13 and the support arm 26. Via the torsion spring 37, the support shaft 25, actuating member 36 and chuck device 12 are normally biased in the clockwise direction of FIG. 2 (counterclockwise direction of FIG. 3). Stopper pin 42 is provided on and projects from a predetermined position of the moving member 13, and the chuck device 12 is held in a posture as shown in FIGS. 2 and 3 by a predetermined portion (i.e., engaging arm 36*b*) of the actuating member 36 abutting against the stopper pin 42. Direction in which the bobbin grasping device 11 is transferred by the transfer section 6 toward the bobbin stock section 5 (i.e., direction of arrow F in FIG. 2) will hereinafter be referred to as "first direction", and the chuck device 12 shown in FIGS. 2 and 3 is oriented (i.e., faces) in the "first direction". Namely, by the biasing force of the torsion spring 37 and engaging force of the stopper pin 42, the chuck device 12 is normally oriented in the "first direction". Further, a direction in which the bobbin grasping device 11 is transferred by the transfer section 6 toward the rotary hook 8 (i.e., direction of arrow R in FIG. 2) will hereinafter be referred to as "second direction".

Orientation changing mechanism is provided in a predetermined position of a stroke of transfer, by the transfer section 6, the bobbin grasping device 11 (i.e., near one end of the transfer stroke adjacent to the rotary hook base 7 in the illustrated example of FIG. 2). Namely, as illustrated in FIG. 2, the support plate 39 is fixed to the second bracket 16 secured to the rotary hook base 7, and engaging pins (projections) 40 and 41 are provided on the support plate 39; the engaging pins (projections) 40 and 41 project from the support plate 39 by appropriate amounts in the direction perpendicular to the guide bars 14. The engaging pins (projections) 40 and 41 project in such a manner that only the actuating member 36 of the bobbin grasping device 11, moving along the guide bars 14, engage with the engaging pins (projections) 40 and 41. In the instant embodiment, the actuating member 36 includes first and second engaging arms 36*a* and 36*b* extending at respective predetermined angles with respect to the support arm 25 of the chuck device 12; namely, the first and second engaging arms 36*a* and 36*b* together form a substantial L shape. Normally, the first engaging arm 36*a* extends upwardly in a substantial vertical direction while the second engaging arm 36*b* extends horizontally, as seen in FIG. 3. The above-mentioned engaging pins (projections) 40 and 41 are spaced apart from each other on the support plate 39, near the one end of the transfer stroke, so that they sequentially engage with the first and second engaging arms 36*a* and 36*b* traveling in the second direction R.

[Orientation Changing Operation]

FIGS. 7A-7E are side views explanatory of how the orientation of the chuck device 12 is changed by the orientation change mechanism (i.e., section where the engaging pins 40 and 41 are provided). More particularly, FIGS. 7A-7E show the guide bars 14 with parts broken away and show members, other than the actuating member 36, of the bobbin grasping device 11 by imaginary lines.

As the bobbin grasping device 11 moves in the second direction R from the position indicated in FIG. 2 (toward the rotary hook base 7) to reach the orientation change mechanism (section where the engaging pins 40 and 41 are provided), the first engaging arm 36*a* of the actuating member 36 abuts against the first engaging pin 40. Following the abutment of the first engaging arm 36*a*, as the bobbin grasping device 11 further moves in the second direction R, the actuating member 36 pivots in the counterclockwise direction against the biasing force of the torsion spring 37, in response to which the chuck device 12 too pivots in the counterclockwise direction. In response to the pivoting movement of the chuck device 12, the second engaging arm 36*b*, having so far lied horizontally, starts moving upward, so that the distal end (free end) of the arm 36*b* gets to a region between the first and second engaging pins 40 and 41 and then arrives at a position where it can abut and engage with the second engaging pin 41 as shown in FIG. 7B. Then, as the bobbin grasping device 11 further moves in the second direction R, the abutment between the first engaging arm 36*a* and the first engaging pin 40 is canceled, and then the actuating member 36 (and chuck device 12) further pivots in the counterclockwise direction by the engagement between the second engaging arm 36*b* and the second engaging pin 41, as shown in FIG. 7C.

Figure 8:
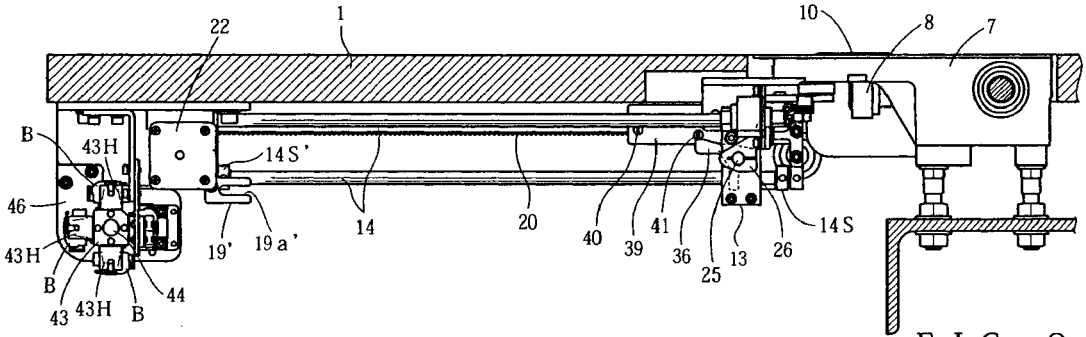
FIG. 8 is a right side view, corresponding to the state of FIG. 7D, which shows the bobbin changer apparatus, rotary hook base and bobbin stock section.
Figure 7A:
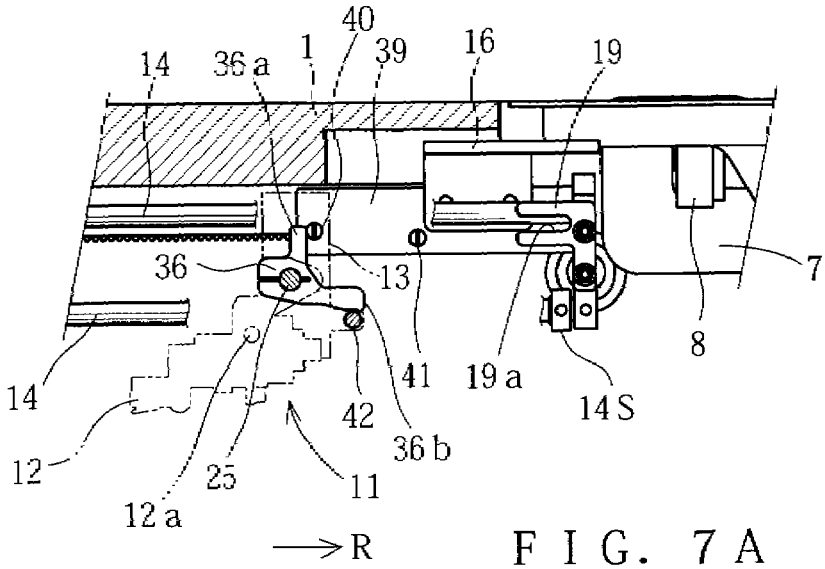
FIGS. 7A-7E are views explanatory of how the orientation of the chuck device is changed by an orientation change mechanism.
Figure 7B:
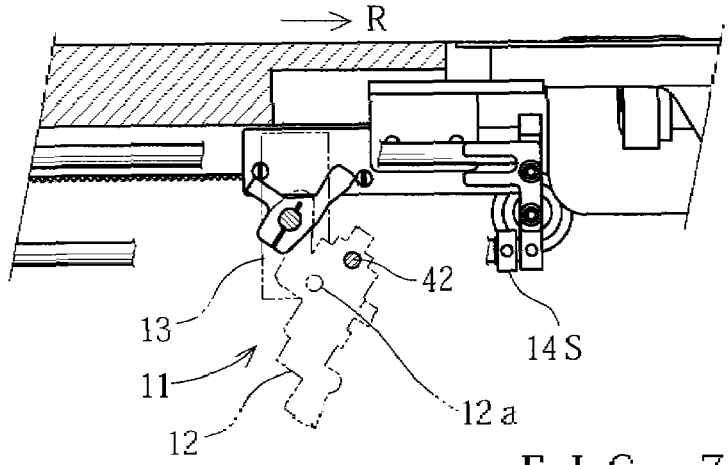
Figure 7C:
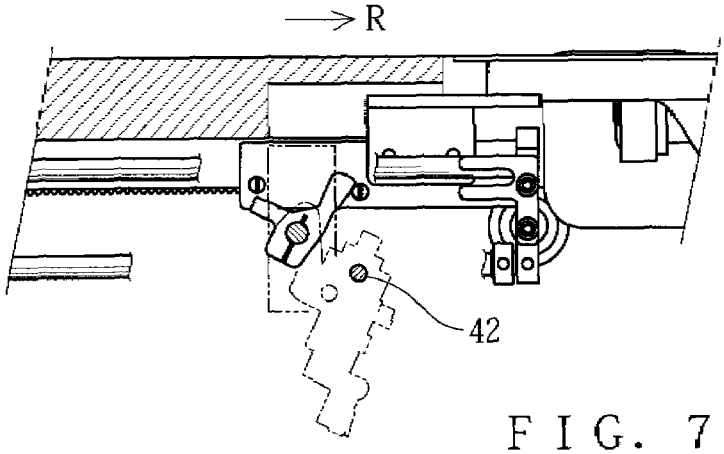
Figure 7D:
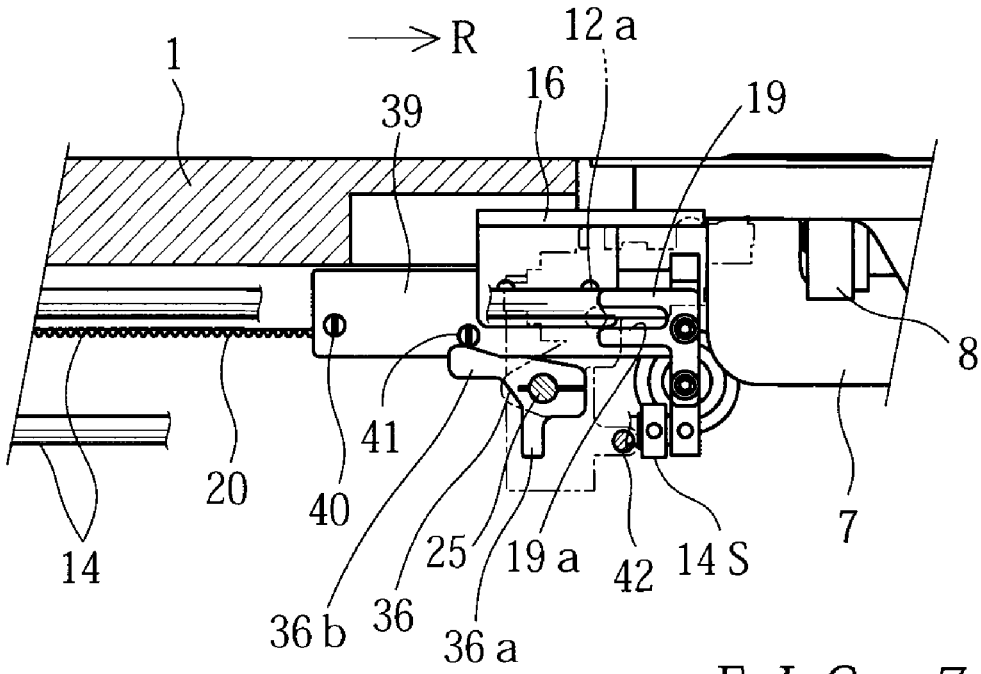

Then, once the bobbin grasping device 11, further moving in the second direction R, reaches a position where the actuating member 36 no longer pivots in the counterclockwise direction, 180° inversion, i.e. orientation change, of the chuck device 12 is completed (i.e., the chuck device 12 has been placed in a state where its distal end is oriented (i.e., faces) in the second direction R, i.e. toward the rotary hook 8), as shown in FIG. 7D. In the orientation-change completed position, the engagement portion 27*a* of the holding member 27 of the chuck device 12 is in alignment with (at the same height as) the front of the bobbin case B mounted in the rotary hook 8, and a positioning pin 12*a* projecting from a predetermined position of the chuck device 12 has reached an opening of a guide groove 19*a* of a guide member 19 fixed to the second bracket 16. FIG. 8 is a right side view, corresponding to a state of FIG. 7D, which shows the bobbin changer apparatus 3, rotary hook base 7 and bobbin stock section 5.

As the bobbin grasping device 11 further moves in the second direction R, the abutting engagement between the second engaging arm 36*b* and the second engaging pin 41 is canceled, but the positioning pin 12*a* fits into the guide groove 19*a* of the guide member 19 and the chuck device 12 is maintained in the posture where it is oriented (i.e., faces) in the second direction R, i.e. toward the rotary hook 8. The guide groove 19*a* of the guide member 19 extends in parallel to the guide bars 14, and the posture of the chuck device 12 does not change after the positioning pin 12*a* fits into the guide groove 19*a* of the guide member 19. Then, when the moving member 13 of the bobbin grasping device 11 has been stopped by abutting against a stopper 14S positionally-adjustably mounted on the guide bar 14, the chuck device 12 is now in a state where it can pass or receive a bobbin case B to or from the rotary hook 8. Namely, when a bobbin case B is to be received from the rotary hook 8, the engagement portion 27*a* of the holding member 27 of the chuck device 12 abuts against the front surface of the bobbin case B mounted in the rotary hook 8. When a bobbin case B is to be passed to the rotary hook 8, on the other hand, the bobbin case B grasped by the chuck device 12 is reliably inserted into the rotary hook 8. In the state shown in FIG. 7E, the linear motor 30 is controlled so that the above-mentioned "grasp operation" is performed when a bobbin case B is to be received from the rotary hook 8 while the above-mentioned "release operation" is performed when a bobbin case B is to be passed to the rotary hook 8.

Figure 7E:
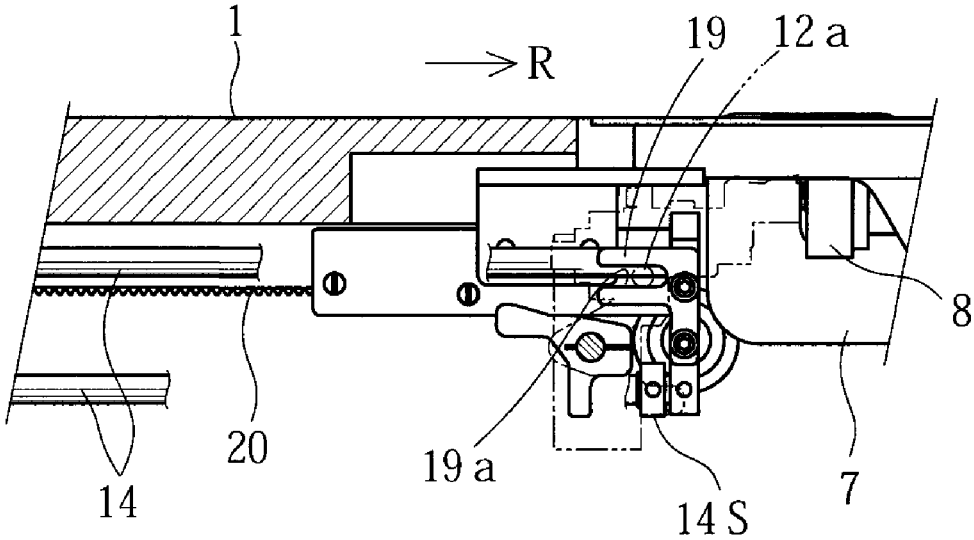

When the bobbin grasping device 11 located in the position shown in FIG. 7E is to be transferred in the first direction F (i.e., toward the bobbin stock section 5), the aforementioned operational sequence of FIGS. 7A-7D is reversed, during which time the actuating member 36 and chuck device 12 are caused to pivot in the clockwise direction by the biasing force of the torsion spring 37. When the second engaging arm 36*b* has abutted against the stopper pin 42, the actuating member 36 is placed in a state where it no longer pivots in the clockwise direction even if the bobbin grasping device 11 further moves in the first direction F, so that 180° inversion, i.e. orientation change, of the chuck device 12 is completed (i.e., the chuck device 12 has been placed in a state where its distal end is oriented in the first direction F, i.e. toward the bobbin stock section 5), as shown in FIG. 7A. After that, the bobbin grasping device 11 is transferred in the first direction F (toward the bobbin stock section 5) with the chuck device 12 kept in the posture where the device 12 is oriented (i.e., faces) in the first direction F, i.e. toward the bobbin stock section 5.

Namely, according to the instant embodiment, the orientation of the chuck device 12 of the bobbin grasping device 11 can be changed, via the single orientation change mechanism provided in the predetermined one position (i.e., section where the engaging pins 40 and 41 are provided) in the transfer stroke, both in the direction toward the rotary hook 8 and in the direction toward the bobbin stock section 5; thus, the instant embodiment can provide a simplified orientation changing construction with a reduced number of component parts. Further, even if the distance between the rotary hook and the bobbin stock section, i.e. transfer distance (over which the bobbin grasping device 11 is transferred), changes depending on the type of the sewing machine, it is only necessary to change the length of the guide bars 14; thus, it is possible to readily deal with such a change in the specifications. Note that the orientation change mechanism (i.e., section where the engaging pins 40 and 41 are provided) may be disposed near the other end of the transfer stroke adjacent to the bobbin stock section 5, rather than at the aforementioned end of the transfer stroke adjacent to the rotary hook 8.

[Bobbin Stock Section]

In the embodiment shown in FIGS. 2-8, the bobbin stock section 5 includes a holding block 43 having four bobbin holding portions 43H provided at 90° angular intervals for holding one bobbin case B each, and a driving motor 45 (FIG. 4) for driving a drive shaft 44 supporting thereon the holding block 43. As shown in FIG. 4, the drive shaft 44 is supported by a base 46 that is in turn fixed to the first bracket 15. The drive shaft 44 is connected to the driving motor 45, and the driving motor 45 is fixed to the base 46 via a base member 47 and stud 48. Further, a positioning cam 49 is fixed to the drive shaft 44.

Figure 9:
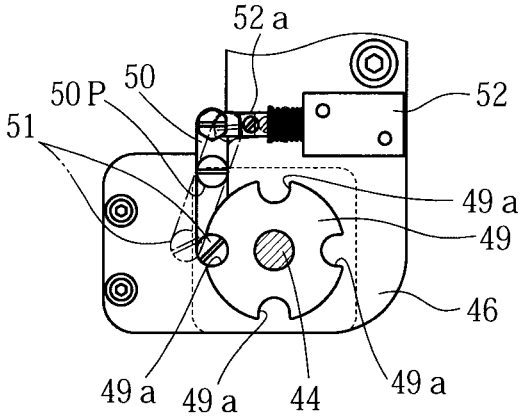
FIG. 9 is an enlarged fragmentary side view of a positioning cam employed in the bobbin stock section.

FIG. 9 is a fragmentary enlarged side view of the positioning cam 49 in the bobbin stock section 5. The positioning cam 49 has four engaging recessed portions 49*a* formed in its outer periphery at 90° angular intervals. Pivotable lever 50 is supported on the base 46 by means of a pin 50P, and the pivotable lever 50 has an engaging pin 51 fixed to one end thereof, and the engaging pin 51 is engageable with any one of the engaging recessed portions 49*a*. The pivotable lever 50 is connected at the other end to a rod 52*a* of a solenoid 52, fixed to the base 46, via a link. The rod 52*a* of the solenoid 52 is normally held in a position indicated by a solid line in FIG. 9. By the engaging pin 51 engaging with any one of the engaging recessed portions 49*a*, a rotational position of the positioning cam 49 is locked, so that rotational positions of the drive shaft 44 and holding block 43 are locked. When the solenoid 52 is not being energized, the rod 52*a* of the solenoid 52 projects by resiliency of a spring.

As the rod 52*a* is retracted, as indicated by an imaginary line in FIG. 9, by activation (energization) of the solenoid 52, the pivot lever 50 pivots in the clockwise direction so that the engaging pin 51 disengages from the engaging recessed portion 49*a*, and thus the locking of the positioning cam 49 is canceled. During that time, any one of the bobbin holding portions 43H can be selectively positioned at a predetermined bobbin changing position by the drive shaft 44 being caused to pivot in 90 degrees by the driving motor 45. For example, when a bobbin case B is to be received from the bobbin grasping device 11, it is only necessary that an empty bobbin holding portion 43H (currently having no bobbin case B held thereby) be selectively positioned at the predetermined bobbin changing position. Further, when a bobbin case B containing a desired lower thread bobbin is to be passed from the stock section 5 to the bobbin grasping device 11, it is only necessary that one of the bobbin holding portions 43H, having held thereby the bobbin case B containing a desired lower thread bobbin, be selectively positioned at the predetermined bobbin changing position. Note that the bobbin-selecting driving motor 45 is provided separately for each of the bobbin changer apparatus 3 corresponding to the rotary hooks 8. Thus, as compared to the conventional bobbin changer apparatus where air cylinders are driven by a common air power supply, the instant embodiment can significantly simplify the drive mechanisms. Further, with the motor provided separately per rotary hook, a desired lower thread can be selected per rotary hook, so that the color of the lower thread can be changed per machine head. In the present invention, lower threads of same characteristics (e.g., white cotton threads) may be contained in the plurality of bobbin cases B held by the bobbin stock section 5 as in the conventional bobbin changer apparatus, or lower threads of different characteristics may be contained in the plurality of bobbin cases B.

[Detection of Presence/Absence of Bobbin Case on the Bobbin Stock Section and Control Based on the Detection]

The above-mentioned predetermined bobbin changing position is where the bobbin holding portion 43H faces the chuck device 12 of the bobbin grasping device 11, transferred by the transfer section 6, so that delivery/receipt of a bobbin case B can be implemented by the chuck device 12. In order to take safety measures and reliable delivery/receipt of the bobbin case B, the bobbin stock section 5 has a microswitch 53 provided thereon for detecting whether or not a bobbin case B is currently held by (i.e., present at) the bobbin holding portion 43H located at the predetermined bobbin changing position. The microswitch 53 includes a detection piece 55 (FIG. 4) that advances or retracts depending on whether or not a bobbin case B is currently held by the bobbin holding portion 43H located at the predetermined bobbin changing position. Namely, when a bobbin case B is currently held by the bobbin holding portion 43H located at the predetermined bobbin changing position, the detection piece 55 retracts by abutting against the bobbin case B, so that the detection piece 55 is turned on. When no bobbin case B is currently held by the bobbin holding portion 43H located at the predetermined bobbin changing position, on the other hand, the detection piece 55 advances, so that the detection piece 55 is turned off.

Figure 10:
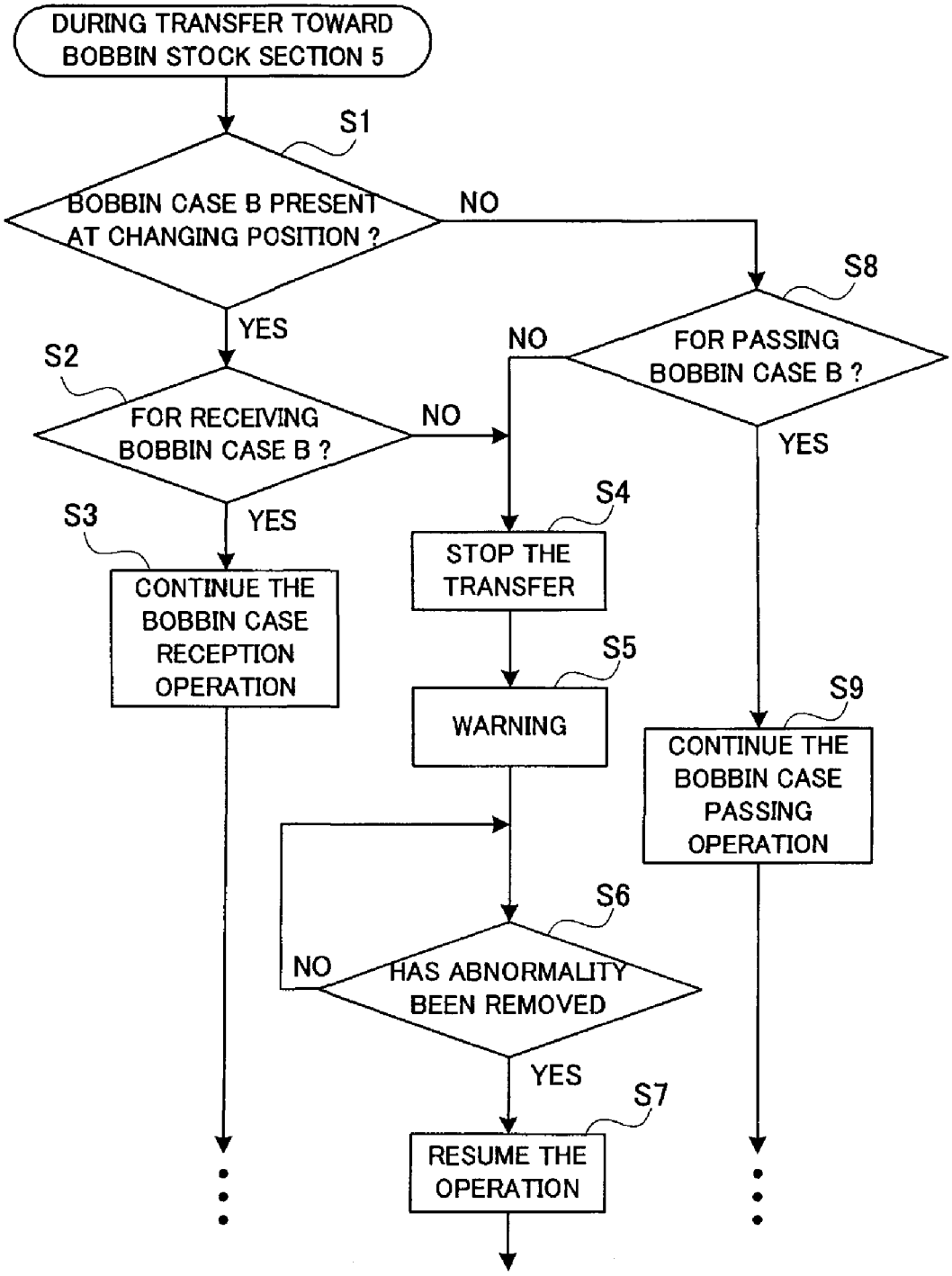
FIG. 10 is a flow chart showing an example of control performed in response to a detection signal indicative of presence/absence of a bobbin case at a predetermined bobbin changing position of the bobbin stock section.

FIG. 10 is a flow chart showing an example of control performed in response to the ON/OFF state of the microswitch 53. This control is performed by a control device, such as a computer, provided in the sewing machine while the bobbin grasping device 11 is being transferred toward the bobbin stock section 5. First, at step S1, a determination is made, in accordance with the ON/OFF state of the microswitch 53, as to whether a bobbin case B is currently held by the bobbin holding portion 43H located at the predetermined bobbin changing position. If it has been determined, at step S1, that a bobbin case B is currently held by the bobbin holding portion 43H, the flow goes to step S2, where a further determination is made as to whether or not the current transfer of the bobbin grasping device 11 toward the bobbin stock section 5 is for the bobbin grasping device 11 to receive a necessary bobbin case B from the bobbin stock section 5. If a YES determination has been made at step S2, it means that the bobbin changer apparatus is currently operating normally, and thus, the control flow proceeds to step S3 in order to continue the bobbin case reception operation. If a NO determination has been made at step S2, on the other hand, it means that the bobbin changer apparatus is currently operating abnormally, because a bobbin case B is currently held by the bobbin holding portion 43H located at the predetermined bobbin changing position although the current transfer of the bobbin grasping device 11 toward the bobbin stock section 5 is for the bobbin grasping device 11 to pass a bobbin case B to the bobbin stock section 5. Therefore, the control flow branches from step S2 to step S4 in order to temporarily stop or halt the transfer, by the transfer section 6, of the bobbin grasping device 11, after which the control flow proceeds to step S5. At step S5, the control device notifies a human operator of warning information by visually displaying a warning message on a display means provided on the operation panel or the like of the sewing machine and/or generating warning voice or sound. In this way, the human operator can take necessary action for removing the abnormality, such as causing another bobbin holding portion 43H with no bobbin case B to be positioned at the predetermined bobbin changing position. At next step S6, the control device checks whether or not the abnormality has been removed. If so, the control device resumes the transfer of the bobbin grasping device 11 to carry on with the operation that was being performed immediately before the stoppage of the transfer.

If a NO determination has been made at step S1, i.e. it has been determined that no bobbin case B is currently held by the bobbin holding portion 43H located at the predetermined bobbin changing position, the control device branches to step S8, where a further determination is made as to whether the current transfer of the bobbin grasping device 11 toward the bobbin stock section 5 is for the bobbin grasping device 11 to pass a bobbin case B to the bobbin stock section 5. If a YES determination has been made at step S8, it means that the bobbin changer apparatus is currently operating normally, and thus, the control flow proceeds to step S9 in order to continue the bobbin case passing operation. If a NO determination has been made at step S8, on the other hand, it means that the bobbin changer apparatus is currently operating abnormally, because no bobbin case B is currently held by the bobbin holding portion 43H located at the predetermined bobbin changing position although the current transfer of the bobbin grasping device 11 toward the bobbin stock section 5 is for the bobbin grasping device 11 to receive a bobbin case B from the bobbin stock section 5. Therefore, the control flow branches from step S8 to step S4 in order to temporarily stop or halt the transfer, by the transfer section 6, of the bobbin grasping device 11, after which the control flow proceeds to step S5. At step S5, the control devices warns the human operator. In this way, the human operator can take necessary action for removing the abnormality, such as causing another bobbin holding portion 43H with no bobbin case B to be positioned at the predetermined bobbin changing position. At next step S6, the control device checks whether or not the abnormality has been removed. If so, the control device resumes the transfer of the bobbin grasping device 11 to carry on with the operation that was being performed immediately before the stoppage of the transfer.

The above-described arrangements can prevent a mechanical damage from occurring by the bobbin grasping device 11 being transferred to pass a bobbin case B to the bobbin stock section 5 when a bobbin case B is currently held at the predetermined bobbin changing position, thereby securing safety. The above-described arrangements can also prevent the possibility that, although no bobbin case B is currently held at the predetermined bobbin changing position, the bobbin grasping device 11 may be transferred to receive a bobbin case B from the predetermined bobbin changing position and then returned to the rotary hook with no replacement bobbin case B; thus, the bobbin changer apparatus can be controlled to perform reliable delivery/receipt of a bobbin case B.

[Bobbin Changing Operation]

The bobbin grasping device 11 is normally held at a standby position a little away from the bobbin stock section 5 toward the rotary hook base 7. Upon detecting that the lower thread in the bobbin case mounted in the rotary hook 8 has run out, the transfer of the bobbin grasping device 11 is started. First, the bobbin grasping device 11 is transferred toward the rotary hook 8 (in the second direction R), the bobbin case B mounted in the rotary hook 8 is chucked by the chuck device 12. Then, the bobbin grasping device 11 is transferred toward the bobbin stock section 5 (in the first direction F), and, once the bobbin grasping device 11 reaches the bobbin stock section 5, it passes the bobbin case B, being held thereby, to an empty bobbin holding portion 43H of the bobbin stock section 5. If, at that time, a bobbin case B is currently set at (i.e., held by) the bobbin holding portion 43H, the bobbin case B grasped by the chuck device 12 will undesirably interfere with the bobbin case B held by the chuck device 12. Thus, when it has been determined, on the basis of the ON/OFF state of the microswitch 53, that a bobbin case B is currently held by the bobbin holding portion 43H, the transfer of the bobbin grasping device 11 is stopped, and the human operator is warned of the presence of the bobbin case B at the bobbin holding portion 43H so that the human operator can remove the abnormality, as set forth above.

After the bobbin case B having run out of the lower thread has been passed to the bobbin stock section 5, not only the chuck device 12 is retracted a little toward the rotary hook 8, but also the holding block 43 of the bobbin stock section 5 is rotated through 90 degrees so that a bobbin case containing a bobbin loaded with a lower thread is positioned at the predetermined bobbin changing position. If it has then been determined, on the basis of the ON/OFF state of the microswitch 53, that no bobbin case B is currently held by the bobbin holding portion 43H located at the predetermined bobbin changing position, the transfer of the chuck device 12 is temporarily stopped, and the human operator is warned of the absence of a bobbin case B so that the human operator can remove the abnormality, as set forth above. If, on the other hand, it has been determined, on the basis of the ON/OFF state of the microswitch 53, that a bobbin case B is currently held by the bobbin holding portion 43H, the chuck device 12 is further transferred toward the bobbin stock section 5, and the bobbin case B held by the bobbin holding portion 43H is chucked by the chuck device 12.

The position where the chuck device 12 is to be stopped upon arrival at the bobbin stock section 5 is controlled by the moving member 13 abutting against a stopper 14S' (FIGS. 2 and 3) positionally-adjustably provided on the lower guide bar 14, in generally the same manner as when the chuck device 12 transferred toward the rotary hook base 7 is to be stopped. Further, when the chuck device 12 has arrived at the bobbin stock section 5, it can be held in a stable posture by the positioning pin 12*a* of the chuck device 12 fits into a guide groove 19*a*' of a guide member 19' (FIGS. 2 and 8) provided on the first bracket 15.

After the chuck device 12 has received a new (i.e., replacement) bobbin case B from the bobbin stock section 5, it is transferred toward the rotary hook base 7 (in the second direction R) and passes the new bobbin case B to the rotary hook 8. After that, the chuck device 12 is returned to the above-mentioned standby position; in this way, one bobbin changing operation cycle is completed.

Alternatively, a bobbin case change may be implemented at any other suitable time than when the lower thread of the bobbin case B mounted in the rotary hook 8 has run out. For example, a bobbin case change may be implemented automatically when the number of embroidering stitches has reached a preset value, or may be implemented as needed in accordance with a manual operation instruction from the human operator or the like.

[Other Embodiment of the Construction for Changing Orientation]

Figure 11A:
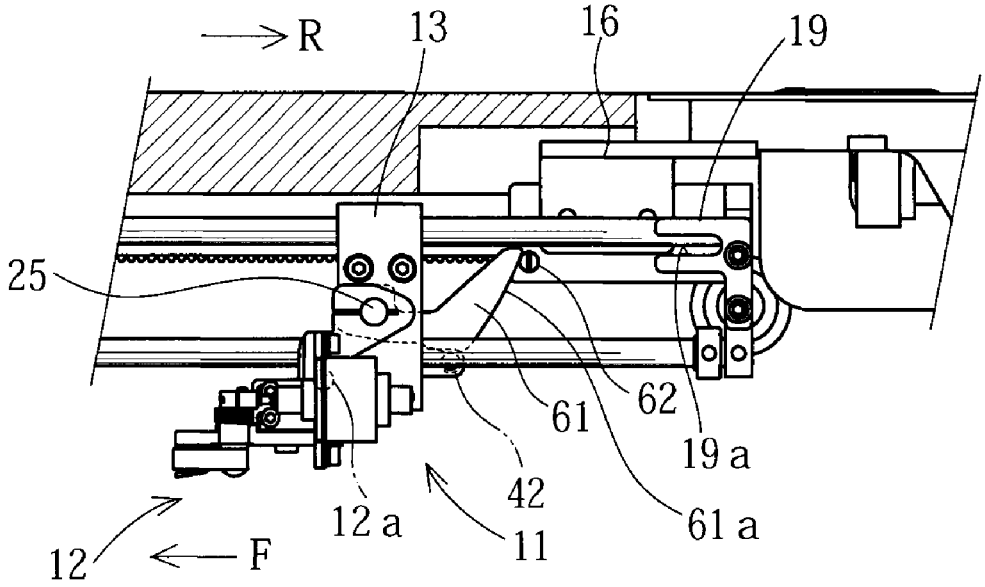
FIG. 11A is an enlarged side view of showing another embodiment of the construction for changing the orientation of the chuck device.
Figure 11B:
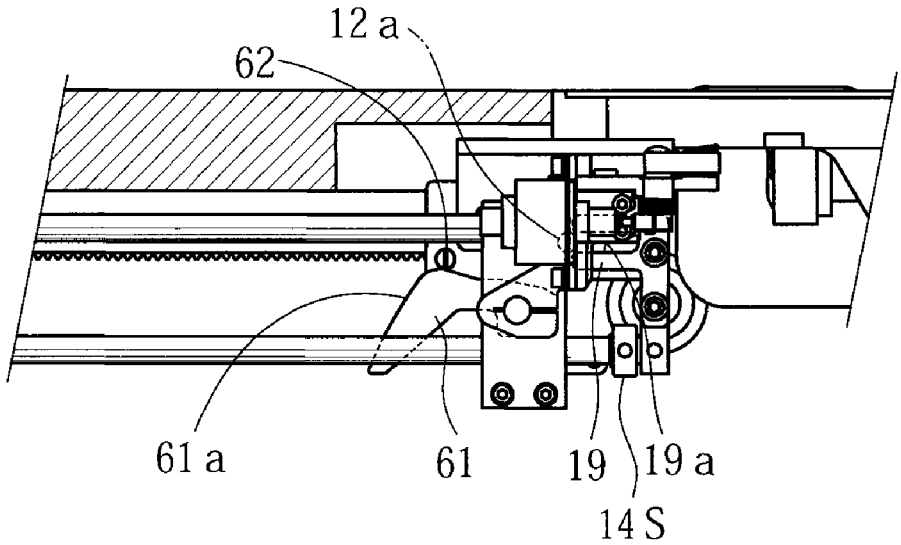
FIG. 11B is a side view showing the orientation of the chuck device having been changed by the embodiment shown in FIG. 11A.

FIGS. 11A and 11B are enlarged side views showing another embodiment of the construction for changing the orientation of the chuck device 12. In this embodiment, the bobbin grasping device 11 employs an actuator member 61 in place of the actuator member 36 employed in the above-described embodiment. The actuator member 61 is mounted on the support shaft 25, similarly to the above-described actuator member 36, and pivotable together with the chuck device 12. The actuator member 61 is different from the above-described actuator member 36 in that it comprises a single cam (i.e., cam surface) 61*a*. One cam-engaging pin (cam-engaging portion) 62 is provided on a predetermined position of the second bracket 16 adjacent to the rotary hook base 7.

Other structural details of the bobbin grasping device 11 in the instant embodiment are similar to those in the above-described embodiment. Namely, the torsion spring 37 (FIG. 4) is fitted over the support shaft 25 between the moving member 13 and the support arm 26. Via the torsion spring 37, the support shaft 25 and the actuating member 36 and chuck device 12 are normally biased in the clockwise direction of FIG. 11A. Stopper pin 42 is provided on and projects from a predetermined position of the moving member 13, and the chuck device 12 is normally held in a predetermined posture oriented in the first direction F (i.e., in a posture where the cam 61*a* is raised) as shown in FIG. 11A by a predetermined portion of the actuating member 61 abutting against the stopper pin 42.

Once the bobbin grasping device 11 arrives at a position indicated in FIG. 11A by being transferred away from the bobbin stock section 5 in the second direction R, the cam surface 61*a* of the actuating member 61 abuts against the engaging pin 62. After the abutment, as the bobbin grasping device 11 is further transferred in the second direction R with the abutting engagement between the cam surface 61*a* and the engaging pin 62 maintained, the actuating member 61 pivots in the counterclockwise direction against the biasing force of the torsion spring 37, in response to which the chuck device 12 too pivots in the counterclockwise direction.

Because of the shape of the cam surface 61*a*, when the actuating member 61 has reached a position where it no longer pivots in the clockwise direction even if the bobbin grasping device 11 further moves in the second direction R, 180° inversion, i.e. orientation change, of the chuck device 12 is completed (i.e., the chuck device 12 has been placed in a state where its distal end is oriented (i.e., faces) in the second direction R, i.e. toward the rotary hook 8), as shown in FIG. 11B. In the orientation-change completed position, the engagement portion 27*a* of the holding member 27 of the chuck device 12 is in alignment with (at the same height as) the front of the bobbin case B mounted in the rotary hook 8, as in the above-described embodiment. Further, the positioning pin 12*a* projecting from a predetermined position of the chuck device 12 has reached the opening of the guide groove 19*a* of the guide member 19 fixed to the second bracket 16. As the bobbin grasping device 11 further moves in the second direction R, the positioning pin 12*a* fits into the guide groove 19*a* of the guide member 19 and the chuck device 12 is maintained in the posture where it is oriented in the second direction R, i.e. toward the rotary hook 8, even after the engagement between the cam surface 61*a* and the engaging pin 62 is canceled. Then, when the moving member 13 of the bobbin grasping device 11 has been stopped by abutting against the stopper 14S positionally-adjustably mounted on the guide bar 14, the chuck device 12 is now in a state where it can pass or receive a bobbin case B to or from the rotary hook 8.

When the bobbin grasping device 11 is to be transferred in the first direction F (toward the bobbin stock section 5) from the position facing the rotary hook 8, the aforementioned operational sequence of FIGS. 11A and 11B is reversed, during which time the actuating member 61 and chuck device 12 are caused to pivot in the clockwise direction by the biasing force of the torsion spring 37. When a predetermined position of the actuating member 61 has abutted against the stopper pin 42 as shown in FIG. 11A, the actuating member 61 is placed in a state where it no longer pivots in the clockwise direction even if the bobbin grasping device 11 further moves in the first direction F, so that 180° inversion, i.e. orientation change, of the chuck device 12 is completed (i.e., the chuck device 12 has been placed in a state where its distal end is oriented in the first direction F, i.e. toward the bobbin stock section 5). After that, the bobbin grasping device 11 is transferred in the first direction F (toward the bobbin stock section 5) with the chuck device 12 kept in the posture where the device 12 is oriented in the first direction F (i.e., toward the bobbin stock section 5).

[Modification of the Chuck Device]

In the above-described embodiments, the claw 28 of the chuck device 12 is integrally coupled with the actuating lever 32 via the pin 31, so that these elements 28 and 32 are always caused to pivot together. However, the present invention is not so limited, and the chuck device 12 may be constructed in a manner as shown in FIG. 12. (a) of FIG. 12 is a perspective view showing a modification of the chuck device 12, and (b) of FIG. 12 is an exploded perspective view showing a modification of the chuck device 12.

In the modification of the chuck device 12 shown in FIG. 12, the actuating lever 32 is fixed to a pin 31T intercoupling the claw 28 and the actuating lever 32, but the claw 28 is fitted over the pin 31T in such a manner that it is pivotable relative to the pin 31T. As clearly seen from (b) of FIG. 12, the claw 28 is rotatably fitted over a shaft portion 63 of the pin 31T.

Further, the claw 28 is normally biased by a torsion spring 66 provided between a flange 65 formed on the pin 31T and the claw 28, and the pivoting movement of the claw 28 is restricted by the claw 28 abutting against a stopper 56. Similarly to the torsion spring 35 shown in FIG. 6, the torsion spring 57 is provided for returning the claw 28 and actuating lever 32 to a predetermined posture. In the instant modification, the claw 28, whose pivoting movement is restricted by abutment against the stopper 56, is caused to pivot relative to the pin 31T by the linearly-moving rod 30*a* of the linear motor 30 being projected, by activation of the linear motor 30, so that the claw 28 fully pulls out the knob B1 of the bobbin case B and then the linearly-moving rod 30*a* being further projected. Consequently, the claw 28 will resiliently hold the knob B1 of the bobbin case B through a resilient restoring force of the torsion spring 66.

[Lower Thread Change Control]

The following paragraphs describe an embodiment of the sewing machine where lower thread change control is performed in accordance with the principles of the present invention.

In the case where each of the needle bar cases 60 in FIG. 1 contains 12 (twelve) needle bars, embroidery using embroidering threads (upper threads) of up to 12 (twelve) colors is permitted through needle bar selection by sliding movement of the needle bar case 60. With the conventionally-known techniques, on the other hand, no lower thread color change corresponding to sewing data could not be implemented, so that a lower thread of only one color (normally, white cotton thread) was used; thus, the reverse sides of embroidery products, where the lower thread appears, tend to be uninteresting or unattractive.

In view of the inconvenience presented by the conventional known techniques, the present invention proposes a novel sewing machine which allows a lower thread color change to be implemented as desired in the course of a sewing operation. Thus, with the sewing machine of the present invention, an embroidery pattern interesting or attractive to a considerable degree can also be formed on the reverse side of an embroidering fabric with lower threads of various colors. Further, threads different in color from upper threads (or needle threads) may be used as lower threads, in which case too a color pattern interesting or attractive to a considerable degree can also be formed on the reverse side of an embroidering fabric by implementing a lower thread color change as necessary; thus, the present invention can manufacture interesting or attractive embroidery products that have heretofore been impossible to manufacture. Whereas the following paragraphs describe lower thread color change control, the present invention is not limited to the lower thread color change, and it can perform control for changing a currently-used lower thread to another lower thread differing from the currently-used lower thread in characteristic, such as a thickness, material or stretching property.

FIG. 13 is a flow chart showing an example operational sequence of a "lower thread change control" routine performed in the course of an embroidery sewing operation based on selected embroidery sewing pattern data. This lower thread change control is performed by the control device, such as a computer, provided in the sewing machine. First, at step S11, a determination is made as to whether a lower thread change signal has been given as a control event. For example, if a lower thread change signal is pre-recorded, as event data including data designating a characteristic (e.g., color) of a replacing lower thread, in a desired storage position, for example, synchronous with upper thread color change timing, of embroidery sewing pattern data, and once the lower thread change signal is read out as the embroidery sewing progresses, a YES determination is made at step S11. Of course, the present invention is not so limited, and a YES determination may be made at step S11 when a lower thread change instruction has been given through manual operation of the human operator.

With a YES determination at step S11, operations of steps S12 and S13 are performed. Namely, at step S12, the operation of the sewing machine is stopped temporarily and the bobbin grasping device 11 is transferred in the second direction R and caused to perform the "grasp operation" for taking out the bobbin case B from the rotary hook 8, as set forth above. Then, the bobbin grasping device 11 is transferred in the first direction F and caused to perform the "release operation", at the predetermined bobbin changing position of the bobbin stock section 5, for passing the bobbin case B to the bobbin stock section 5. Because this routine is intended to implement a lower thread change, it does not necessarily matter whether the lower thread in the bobbin case B mounted in the rotary hook 8 has run short or not.

At step S13, a bobbin case B containing the lower thread of the desired characteristic (e.g., color) is selected in the bobbin stock section 5 in accordance with the lower thread designating data included in the lower thread change signal read out as the current control event, and the thus-selected bobbin case B is positioned at the predetermined bobbin changing position. The bobbin grasping device 11 is transferred in the first direction R and caused to perform the "grasp operation" to take out the bobbin case B from the predetermined bobbin changing position of the bobbin stock section 5 and grab the taken-out bobbin case B, as set forth above. Then, the bobbin grasping device 11 is transferred in the second direction R and caused to perform the "release operation", in front of the rotary hook 8, for passing the bobbin case B to the rotary hook 8.

[Various Modifications of the Bobbin Stock Section]

The construction of the bobbin stock section 5 is not limited to the one in the above-described embodiments and may be modified variously. Particularly, in order to permit changes among lower threads of various characteristics (e.g., colors), it is desirable that the number of bobbin cases B capable of being held by the bobbin stock section 5 be greater; for example, it is desirable that the number of the bobbin cases B capable of being held by the bobbin stock section 5 be about the same as the number of the needle bars contained in the needle bar case 60 of the upper threads. Further, if a lower-thread replenishing bobbin change responsive to detection of a lower thread shortage too is taken into account, it is preferable that the bobbin stock section 5 be capable of holding a greater number of bobbin cases B with a small-size construction. Modifications of the bobbin stock section 5 constructed from such a perspective will be described with reference to FIGS. 14 and 15.

(a) of FIG. 14 is a schematic plan view showing a modified bobbin stock section 101 and rotary hook 8 corresponding thereto. In the figure, a one-dot-dash line K schematically shows a movement or transfer path of the chuck device 12 between the rotary hook 8 and the bobbin stock section 101. (b) of FIG. 14 is a right side view of a bobbin stock section 101 slightly different in construction from the bobbin stock section 101 shown in (a) of FIG. 14. Reference numeral 102 indicates a single, common operating shaft 102 provided for shared use among all of the bobbin stock sections 101 corresponding to the rotary hooks 8, and the common operating shaft 102 extends along almost the entire width of the machine table 1 under the lower surface of a front end edge portion of the machine table 1. Mounting blocks 103 are fixed to the operating shaft 102 in correspondence with the individual rotary hooks 8. Holding member 104 for holding a plurality of bobbin cases B side by side in a row in a longitudinal direction of the operating shaft 102 is detachably attached to each of the mounting blocks 103. In (a) of FIG. 14, one of the plurality of bobbin cases B held on the holding member 104 is located at the predetermined bobbin changing position (i.e., position on the one-dot-dash line K where the one bobbin case B can be chucked by the chuck device 12). The operating shaft 102 is connected at its one end to a not-shown drive device, so that the shaft 102 can be driven to linearly slide in an axial direction of the shaft 102 in distances equal to intervals between the bobbin cases B held side by side on the holding member 104 and can be rotated about its axis. The linear sliding driving of the operating shaft 102 may be linked to the sliding driving of the needle bar case 60.

In the illustrated example of (a) of FIG. 14, only one holding member 104 (one row of bobbin cases B) is attached to the mounting block 103. But, the present invention is not so limited, and a plurality of holding members 104 may be attached to the mounting block 103 at angular intervals (e.g., 90° intervals) about the operating shaft 102 as shown in (b) of FIG. 14. For example, three holding members 104, each holding four bobbin cases B, may be attached to the mounting block 103 as shown in (b) of FIG. 14, in which case a total of 12 (twelve) bobbin cases B can be held by the bobbin stock section 101. This means that lower thread changes among 12 different colors is permitted per machine head 2 in correspondence with the construction (i.e., needle bar case 60 containing 12 needles) that permits upper thread changes among 12 different colors. In the illustrated example of (b) of FIG. 14, one of the bobbin cases B which contains a lower thread of a desired color contained therein can be positioned at the predetermined bobbin changing position or an empty holding position with no bobbin case B can be positioned at the predetermined bobbin changing position, by rotationally and linearly driving the operating shaft 102. The present invention is of course not so limited, and the number of bobbin cases B linearly held on each holding member 104 and the number of holding members 104 provided at predetermined angular intervals about the operating shaft 102 may be set as desired.

In the illustrated example of (a) of FIG. 14, the holding member 104 can be oriented in the forward direction of the machine table 1 (i.e., toward the human operator operating the machine) by rotating the operating shaft 102 through 180 degrees. By thus orienting the holding member 104 in the forward direction of the machine table 1, the human operator can perform, with utmost ease, manual operation for changing the holding member 104 or changing any of the bobbin cases B on the holding member 104.

(a) of FIG. 15 is a schematic plan view showing another modified bobbin stock section 110 and rotary hook 8 corresponding thereto. In this figure too, a one-dot-dash line K schematically shows a movement path of the chuck device 12 between the rotary hook 8 and the bobbin stock section 110. (b) of FIG. 15 is a right side view of the bobbin stock section 110. In the illustrated examples of FIG. 15 too, a single, common operating shaft 105 provided for shared use among all of the bobbin stock sections 110 corresponding to the rotary hooks 8 extends along almost the entire width of the machine table 1 under the lower surface of a front end edge portion of the machine table 1. Cylindrical holding blocks 106 are mounted on the operating shaft 105 in corresponding relation to the rotary hooks 8, and each of the cylindrical holding blocks 106 is for detachably holding a plurality of bobbin cases B circumferentially about the operating shaft 105. A plurality of, rather than just one, holding blocks 106 may be mounted in parallel along the axis of the operating shaft 105. In the illustrated example, there are provided two such holding blocks 106 each holding six bobbin cases B, so that a total of 12 (twelve) bobbin cases B can be held by each of the bobbin stock sections 110. In this case too, any one of the bobbin cases B which has a lower thread of a desired color contained therein can be positioned at the predetermined bobbin changing position or an empty holding position with no bobbin case B can be positioned at the predetermined bobbin changing position, by rotationally and linearly driving the operating shaft 105.

The present invention is not limited to the aforementioned construction where the single, common operating shaft 102 or 105 in FIG. 14 or 15 is provided for all of the bobbin stock sections 101 or 110 corresponding to the rotary hooks 8; for example, the common operating shaft 102 or 105 may be provided for each predetermined group of the bobbin stock sections or for each of the bobbin stock sections.

[Other Embodiment of the Construction for Changing Orientation]

The above-described embodiments are constructed in such a manner that the orientation of the chuck device 12 of the bobbin grasping device 11 can be changed by one orientation changing mechanism, in a predetermined position (i.e., section where the engaging pins 40 and 41 or the engaging pin 62 is provided) of the transfer stroke of the bobbin grasping device 11, both in the direction toward the rotary hook 8 and in the direction toward the bobbin stock section 5 (or 101 or 110). Alternatively, an orientation changing motor 200 of a small size may be mounted on the bobbin grasping device 11 as shown in FIG. 16, without the orientation changing mechanism being provided in a predetermined position of the transfer stroke of the bobbin grasping device 11, so that the orientation of the chuck device 12 can be changed via the orientation changing motor 200.

Namely, in the illustrated example of FIG. 16, the orientation changing motor 200 (indicated by a dotted line in the figure) is mounted on a side of the moving member 13 of the bobbin grasping device 11 opposite from the side of the moving member 13 where the chuck device 12 is mounted, and the chuck device 12 is connected, via the support arm 26, to a rotation shaft 200*a* of the orientation changing motor 200. Such arrangements allow the chuck device 12 to be rotated as the motor 200 rotates. Thus, if the rotation shaft 200*a* of the orientation changing motor 200 is rotated through 180 degrees in one direction from the state where the chuck device 12 is orientated in the first direction F, for example, the orientation of the chuck device 12 can be changed so that the device 12 is oriented in the second direction R. Conversely, if the rotation shaft 200*a* of the orientation changing motor 200 is rotated through 180 degrees in the other (or opposite) direction, the orientation of the chuck device 12 can be changed so that the device 12 is oriented in the first direction F.

The orientation change of the chuck device 12 may be controlled by controlling the rotational angle of the motor 200. Whereas it is preferable that a motor suited for positioning control, such as a pulse motor, be used as the orientation changing motor 200, any other suitable type of motor may be used as the orientation changing motor 200. Further, the present invention is not limited to the above-described construction where the support arm 26 of the chuck device 12 is connected directly to the rotation shaft 200*a* of the orientation changing motor 200, and the support arm 26 of the chuck device 12 may be connected to the rotation shaft 200*a* via a speed-changing or transmission mechanism, such as a gear. Note that the orientation changing operation based on rotational driving by the motor 200 may be performed at any suitable position during the transfer of the bobbin grasping device 11. For example, the orientation change may be implemented by quickly rotating the orientation changing motor 200, or by slowly rotating the orientation changing motor 200 over a considerable part or whole of the transfer stroke. Further, instead of the orientation of the chuck device 12 being changed during the transfer of the bobbin grasping device 11, the orientation of the chuck device 12 may be implemented by temporarily stopping (halting) the transfer of the bobbin grasping device 11 and rotating the orientation changing motor 200 during the temporary stoppage of the bobbin grasping device 11.

[Other Embodiment of the Bobbin Stock Section]

FIGS. 17-21 shows still another embodiment 150 of the bobbin stock section. More specifically, FIG. 17 is a front view of the bobbin stock section 150, in which a rotary-type bobbin holder unit 151, capable of holding a plurality of bobbin cases B arranged in a circumferential direction of the holder 151, can be detachably attached. The bobbin stock section 150 has a space formed by a first base member 152 fixed to the first bracket 15 (see FIG. 2) and a second base member 153 fixed to the first base member 152, and the bobbin holder unit 151 can be detachably set in the above-mentioned space. FIG. 18 is a front view of the bobbin holder unit 151 as detached from the bobbin stock section 150, and FIG. 19 is a left side view of the bobbin holder unit 151 as detached from the bobbin stock section 150. The bobbin holder unit 151 has four holding portions 154H, each for holding one bobbin case B, provided at 90° intervals on and along the outer periphery of a holding block 154; thus, a total of four bobbin cases B can be set on the bobbin holder unit 151. Shaft 155 extends through the holding block 154, and two stoppers 156 are fixedly mounted on the shaft 155 so as to be located adjacent to opposite sides of the holding block 154. As shown in FIG. 18, opposite end portions of the shaft 15 project beyond the two stoppers 156, and these projecting opposite end portions of the shaft 15 function as engaging portions 155*a* and 155*b* to be used for attaching the bobbin holder unit 151 to the bobbin stock section 150.

In each of the holding portions 154H, there are provided a thread hook member 157 for hooking thereon a lower thread paid out from the bobbin case B set therein, and a thread holding member 159 having a thread holding portion 158 for holding a distal end portion of the lower thread T. The thread holding portion 158 comprises a dual structure formed by bending a plate and holds the distal end portion of the lower thread T between opposed portions of the bent plate. The distal end of the bent plate is formed as a cutting portion 158*a* capable of cutting the thread. When a bobbin case B is set on the holding portion 154H, a portion of the lower thread T paid out from the bobbin case B is hooked on the thread hook member 157 and then held by the thread holding portion 158, and then an excessive distal end part of the paid-out lower thread portion is cut off by the cutting portion 158*a*. Because the distal end portion of the lower thread T is reliably held or sandwiched by the thread holding portion 158, it can be prevented from disengaging from the thread holding portion 158 as the bobbin holder unit 151 is rotated. Further, the thread holding member 159 has a mounting portion in the form of an elongated hole 159*a* (FIG. 19), and the vertical position of the thread holding member 159 can be adjusted, as indicated by an imaginary line in FIG. 18, by loosening a mounting screw 160. By adjusting the vertical position of the thread holding member 159, the portion of the lower thread T paid out from the bobbin case B can be adjusted in length; the portion of the lower thread T paid out from the bobbin case B when the bobbin case B has been set in the rotary hook 8 can be made to have an appropriate length.

Driving motor 161 for rotating the bobbin holder unit 151 is fixed to the first base member 152 of the bobbin stock section 150. Positioning cam 162 is connected to the shaft of the driving motor 161, and a boss portion 162*a* of the positioning cam 162 has an engaging recessed portion 163 in which a left engaging portion of the bobbin holder unit 151 is engaged. The positioning cam 162 is a moving member moved by the driving motor 161, and the bobbin holder unit 151 is detachably attached to the moving member (positioning cam 162), as will be detailed below. FIG. 20 is a sectional view taken along the I-I line of FIG. 17. As clearly seen from the figure, the left engaging portion 155*b* of the bobbin holder unit 151 has a straight upper surface in which is formed a recessed portion 165, and a distal end portion of a ball plunger 164 fixed to the boss portion 162*a* is engaged in the recessed portion 165. Actuating pin 166 having its distal end inserted in the engaging recessed portion 163 is slidably provided on the boss portion 162*a*. Coil spring 167 is mounted on the actuating pin 166, by which a flange-shaped stopper 168 is normally biased to abut against the bottom surface of the engaging recessed portion 163. Distal end portion of the actuating pin 166 projecting beyond the stopper 168 is fitted in an engaging hole 169 formed in the left engaging portion 155*b*. Pushing portion 170*a* formed at the distal end of an upwardly-extending lever portion of an actuating lever 170 is located rearwardly of the actuating pin 166. The actuating lever 170 is fixedly mounted on a shaft 171 that is in turn supported at opposite ends to the first base member 152 and second base member 153, and an operating portion 170*b* is formed at the distal end of a forwardly-extending lever portion of the actuating lever 170. Torsion spring 172 for normally biasing the actuating lever 170 in a clockwise direction of FIG. 20 is provided on the shaft 171, so that the actuating lever 170 is normally held at a pivotal position where its operating portion 170*b* abuts against a restricting member 173 fixed to the first base member 152.

Lock mechanism 174 for locking a rotational position of the positioning cam 162 is provided on the first base member 152. Constructions of these lock mechanism 174 and positioning cam 162 are similar to the construction related to the positioning cam 49 described above in relation to FIG. 9 and thus will not be described below to avoid unnecessary duplication.

FIG. 21 is a sectional view taken along the II-II line of FIG. 17. As clearly seen from the figure, a guide member 175 is fixed to the second base member 153, and a holding member 176 is pivotably provided above the guide member 175. The holding member 176 has a locking portion 176*b*, and an engaging recessed portion 176*a* in which is engaged the right engaging portion 155*a* of the bobbin holder unit 151. Above the holding member 176, there is provided a wire spring 177 for normally biasing the locking portion 176*b* of the holding member 176 to abut against an engagement portion 175*a* formed on the guide member 175. Actuating portion 178*a* formed at a distal end portion of a driven lever 178 fixedly mounted on the shaft 171 is located rearwardly of the holding member 176.

Next, a description will be given about how the bobbin holder unit 151 is attached to the bobbin stock section 150 constructed in the manner as shown in FIGS. 17-21.

First, a bobbin case B is set onto each of the holding portions 154H of the bobbin holder unit 151, and an end portion of the lower thread T is held by the thread holding portion 158 of the thread holding member 159. Then, the bobbin holder unit 151 is placed in a position (posture) where the straightly-formed surface of the left engaging portion 155*b* becomes the upper surface of the left engaging portion 155*b* as shown in FIG. 18, the right engaging portion 155*a* of the bobbin holder unit 151 is inserted between the guide member 175 and holding member 176 of the stock section 150, and the left engaging portion 155*b* of the bobbin holder unit 151 is pushed into the engaging recessed portion 163 (FIG. 17). Openings of the portions (175, 176 and 163) have slanted surfaces such that the two engaging portions 155*a* and 155*b* can be smoothly inserted therein (see FIGS. 20 and 21). As the right engaging portion 155*a* enters between the guide member 175 and the holding member 176, the holding member 176 pivots upward against the biasing force of the wire spring 177. Once the right engaging portion 155*a* reaches the engaging recessed portion 176*a* of the holding member 176, the holding member 176 pivots downward by the biasing force of the wire spring 177, so that the right engaging portion 155*a* is engaged and held in the engaging recessed portion 176*a* as indicated by a solid line in FIG. 21.

On the other hand, the left engaging portion 155*b* deeply enters the engaging recessed portion 163, and a distal end portion of the actuating pin 166 is fitted into the engaging hole 169. Once the actuating pin 166 reaches a position as indicated by a solid line in FIG. 20, the distal end portion of the ball plunger 164 is engaged and held reliably in the recessed portion 165 against displacement.

In the aforementioned manner, the bobbin holder unit 151 can be set on the bobbin stock section 150. Note that the bobbin holder unit 151 is limited in its left-right horizontal position by the positioning stopper 156. As the driving motor 161 is activated in this state with the locking, by the lock mechanism 174, of the positioning cam 162 canceled, the bobbin holder unit 151 with the left engaging portion 155*b* engaged in the engaging recessed portion 163 rotates together with the positioning cam 162, so that a desired one of the holding portions 154H in the bobbin holder unit 151 can be positioned at the predetermined bobbin changing position.

Next, a description will be given about how the bobbin holder unit 151 is detached from the bobbin stock section 150 in FIGS. 17-21.

First, the positioning cam 162 is rotated so that the actuating pin 166 is retracted as shown in FIG. 20. At that time, the positioning cam 162 may be rotated through activation of the driving motor 161, or the human operator may manually cancel the locking by the lock mechanism 174, as indicated by an imaginary line in FIG. 20, to manually rotate the positioning cam 162. Then, the operating portion 170*b* of the actuating lever 170 is depressed to cause the actuating lever to pivot as indicated by an imaginary line in FIG. 20. In this manner, the actuating pin 166 slides by being pushed by the pushing portion 170*a* of the actuating lever 170, so that the engagement between the distal end of the ball plunger 164 and the recessed portion 165 is canceled and thus the left engaging portion 151*b* of the bobbin holder unit 151 is pushed out. As the actuating lever 170 pivots, the driven lever 178 too pivots, as indicated by an imaginary line in FIG. 21, via the shaft 171. Thus, the holding member 176 pivots upward by being pushed by the actuating portion 178*a* of the driven lever 178, so that the engagement between the engaging recessed portion 176*a* of the holding member 176 and the right engaging portion 155*a* of the bobbin holder unit 151 is canceled and the right engaging portion 155*a* is pushed out. Namely, as the actuating lever 170 pivots, the engagement by the engaging portions 155*a* and 155*b* of the bobbin holder unit 151 is canceled, and the engaging portions 155*a* and 155*b* are pushed out forward. In this way, the bobbin holder unit 151 can be detached from the bobbin stock section 150.

Because the bobbin holder unit 151 having a plurality of bobbin holding portions 154H is detachably attached to the bobbin stock section 5, a plurality of bobbin cases B can be set collectively on the bobbin stock section 150 in a short period of time.

Further, in the instant embodiment, as shown in FIG. 17, a mode selection switch 179, operation switch 180, first LED (Light Emitting Diode) 181 and second LED 182 are provided on the second base member 153. The mode selection switch 179 is operable to select an ALL mode in which bobbin changes are implemented collectively in all of the machine heads, an INDIVIDUAL mode in where a bobbin change is implemented only in the instant bobbin changer apparatus, or a REST mode in which the instant bobbin changer apparatus is brought to a resting (or non-operating) condition. The operation switch 180 is operable to instruct a bobbin change, and the bobbin change is implemented in accordance with the mode selected by the mode selection switch 179. Namely, when the ALL mode is selected by the mode selection switch 179, bobbin changes are implemented in all of the bobbin changer apparatus in response to ON operation of the operation switch 180. When the INDIVIDUAL mode is selected by the mode selection switch 179, a bobbin change is implemented only in the instant bobbin changer apparatus. Further, when the REST mode is selected by the mode selection switch 179, no bobbin change is implemented in any one of the bobbin changer apparatus. To perform specific control for such purposes, output signals of the mode selection switch 179 and operation switch 180 are input to the control device (not shown), comprising for example a computer, and a predetermined bobbin changing program is executed in accordance with operating states of the mode selection switch 179 and operation switch 180. Note that the mode selection switch 179 and operation switch 18 may be of self-resetting switches or of any other suitable type which switches between a plurality of operating positions.

The above-mentioned first LED 181 is illuminated (in green color) while the bobbin changer apparatus is in an operable condition with the sewing machine powered on. The above-mentioned second LED 182 is illuminated (in red color) while the REST mode is selected, and it is blinked when some error has occurred in the bobbin changer apparatus in question. By providing the above-mentioned switches and display elements, such as LEDs, for each of the bobbin changer apparatus, the human operator can check conditions of the bobbin changer apparatus, and then and there it can cause the bobbin changer apparatus to implement a bobbin change. The display elements employed in the instant embodiment are not limited to LEDs and may be other suitable display means, such as lamps.

Further, in the instant embodiment, there is provided a notification means, such as an alarm sound generation device, for notifying the human operator that the bobbin stock section has become empty by all of bobbin cases B loaded with respective lower threads, set on the bobbin holder unit 151, having been exchanged for empty bobbin cases, or that the bobbin stock section has become almost empty by most of the bobbin cases, set on the bobbin holder unit 151, having been exchanged for empty bobbin cases. Such an alarm means is provided for each of the bobbin stock sections 150. The notification means prompts the human operator to set new (replacement) bobbin cases B loaded with lower threads into the bobbin holder unit 151, in response to which the human operator detaches the bobbin holder unit 151, holding the empty bobbin cases B, from the bobbin stock sections 150 and sets new bobbin cases B loaded with lower threads into the bobbin holder unit 151. If all of the bobbin cases B have been exchanged (become empty) in only a particular one (or ones) of the bobbin changer apparatus provided in the sewing machine, a display for distinguishing the particular bobbin changer apparatus from the other bobbin changer apparatus may be made, for example, by blinking both of the first and second LEDs 181 and 182 of the particular bobbin changer apparatus. In this way, the human operator can identify at a glance in which of the bobbin changer apparatus new bobbin cases B loaded with lower threads should be set onto the bobbin stock section.

[Other Embodiment of the Chuck Device]

FIGS. 22 and 23 show another (second) embodiment of the chuck device in the bobbin grasping device 11, and this chuck device (second embodiment) 183 shown in FIGS. 22 and 23 differs in construction from the chuck device (first embodiment) 12 shown in FIG. 6 etc. In this chuck device 183, a holding member 184 for receiving and holding a bobbin case B is slidably mounted on a support arm 185 for connecting the chuck device 183 to the transfer mechanism. The support arm 185, which corresponds to the support arm 26 shown in FIGS. 2-6, is mounted on the moving body 13 (see FIGS. 2 and 3) via the support shaft 25 (see FIGS. 2 and 3). The holding member 184 has a mounting portion in the form of an elongated hole 184*b* having two stepped screws 186 fitted therein, and thus, the holding member 184 are slidably mounted on the support arm 185. Namely, the holding member 184 is slidable relative to the support arm 185 within a range indicated by solid and imaginary lines in FIG. 22 (i.e., range permitted by the elongated hole 184*b*). The claw 28, linear motor 30, actuating lever 32, etc. slide together with the holding member 184. The holding member 184 has a supporting piece 188, provided on its bottom surface, for slidably supporting a rod 187. The rod 187 is fixed at its proximal end portion to a distal end portion of the support arm 185. The rod 187 moves with the support arm 185, and the supporting piece 188 moves with the holding member 184. Coil spring 189 is provided between the support arm 185 and the supporting piece 188 as shown in FIG. 23. By the biasing force of the coil spring 189, the holding member 184 is normally held in a position indicated by a solid line in FIG. 22. Other structural details of the chuck device 183 are similar to those of the chuck device 12 shown in FIG. 6.

When transferred to grasp a bobbin case B, this chuck device 183 can move closer to the bobbin case B than the first embodiment of the chuck device 12. Such movement of the chuck device 183 will be described in detail in relation to a case where the chuck device 183 is transferred to receive the bobbin case B mounted in the rotary hook 8. FIG. 23 is a side view showing a state where an engaging portion 184*a* of the holding member 184 has abutted against the front surface of the bobbin case B by the chuck device 183 being moved toward the rotary hook 8. Whereas the movement of the first embodiment of the chuck device 12 is stopped at the time point when the engaging portion 184*a* of the holding member 184 has abutted against the front surface of the bobbin case B, the second embodiment of the chuck device 183 is moved further toward the rotary hook 8 after the engaging portion 184*a* of the holding member 184 has abutted against the front surface of the bobbin case B. Namely, the holding member 184 does not move due to the abutting engagement with the bobbin case B, and only the support arm 185 in the second embodiment of the chuck device 183 moves toward the rotary hook 8 as indicated by an imaginary line. In this manner, the coil spring 189 is compressed so that the holding member 184 is strongly pressed against the bobbin case B, and thus, the bobbin case B can be grasped reliably. Namely, by the holding member 184 being pressed against the bobbin case B with the biasing force of the coil spring 189, the chuck device 183 can reliably grasp the bobbin case B to be received from the rotary hook 8. Namely, the bobbin case B to be received can be reliably grasped by the biasing force of the coil spring 189 pressing the holding member 184 against the bobbin case B.

When a bobbin case B is to be passed from the chuck device 183 to the rotary hook 8, on the other hand, the chuck device 183 behaves as follows. Namely, after the grasping of the bobbin case B is canceled by disengaging the claw 28 and even if the support arm 185 moves away from the rotary hook 8 (or from the bobbin holder unit 150 of the bobbin stock section), the holding member 184 keeps pressing the bobbin case B for some time (i.e., over a predetermined range the holding member 184 of the chuck device 183 slides relative to the support arm 185), with the result that the bobbin case B can be reliably passed to the rotary hook 8 or bobbin holder unit 150.

In each of the bobbin changer apparatus, a sensor (not shown) for detecting when the chuck device 183 has moved to arrive at a particular target position slightly before a predetermined stop position close to the rotary hook 8 or bobbin stock position. Once the arrival, at the particular target position, of the chuck device 183, the movement of the chuck device 183 is temporarily stopped (halted) and the driving motor 22 is deactivated, and the control waits until the chuck devices 183 of all of the other bobbin changer apparatus, which are currently implementing bobbin changes, arrive at the same position. Once the chuck devices 183 of all of the bobbin changer apparatus arrive at the same position, the driving motor 22 is activated to move the chuck device 183 to the predetermined stop position. Namely, by performing such control for synchronizing the chuck devices 183 of all of the bobbin changer apparatus, it is possible to prevent the motor 22 of a particular chuck device 183, having arrived at the target position earlier than the other chuck devices 183, from stepping out in a case where there are differences in movement among the chuck devices 183 of the bobbin changer apparatus.

The above-described first embodiment of the chuck device 12 too may press the holding member 27 against the bobbin case B by further activating the transferring motor 22 and causing the motor 22 to step out after the engagement portion 27*a* of the holding member 27 has abutted against the front surface of the bobbin case B. However, causing the motor 22 to step out would produce undesired step-out sound; in the case where the sewing machine is equipped with a multiplicity of bobbin changer apparatus, the step-out sound would become extremely great sound noise. By contrast, the second embodiment of the chuck device 183 will never present such a sound noise problem.

[Control on Each Machine Head]

The multi-head embroidery sewing machine may sometimes be caused to operate with some of the plurality of machine heads placed in the operating condition and the other machine heads placed in the resting or non-operating condition. In such a case, bobbin changes are implemented only in the bobbin changer apparatus corresponding to the machine heads 2 placed in the operating condition. Whether the bobbin changer apparatus should be placed in the operating condition or in the resting condition may be set either automatically in accordance with the operating/resting settings of the machine heads 2 or by the human operator. In the case where operating/resting settings of the bobbin changer apparatus are made by the human operator, arrangements may be made to facilitate the operating/resting setting operation; for example, two machine head groups may be formed of every second machine head and the remaining machine heads (e.g., group of odd-numbered machine heads and group of even-numbered machine heads) so that bobbin changes are implemented in either one of the groups.

Namely, according to each of the above-described embodiments, the chuck device 12 (or 183) can be selectively caused to face toward the rotary hook 8 or bobbin stock section 5 (or 101 or 110) by being caused to pivot through a predetermined angle via the motor 200 mounted on the bobbin grasping device. Thus, it is possible to provide a simplified orientation changing construction with an even further reduced number of component parts. Further, even if the distance (i.e., transfer distance) between the rotary hook 8 and the bobbin stock section 5 differs depending on the type of the sewing machine used, only the length of the guide bars 14 have to be changed, so that it is possible to readily deal with such a change in the specifications.

Further, whereas the embodiments have been described as constructed in such a manner that each empty bobbin case B taken out from the rotary hook 8 is temporarily stored into the bobbin stock section 5 (or 101, 110 or 150), the present invention is not so limited, and each empty bobbin case B may be recovered partway through the transfer stroke without being transferred to the bobbin stock section 5, 101, 110 or 150. For example, a bobbin reception section, such as a gutter or belt conveyor, may be provided under the transfer path of the transfer section 6, in which case the empty bobbin case B is released from the chuck device 12 and dropped to the bobbin reception section during the transfer of the chuck device 12 with the empty bobbin case B grasped thereby. Such release of the bobbin case B may be performed while the transfer of the bobbin grasping device 11 is in a temporarily-stopped (halted) state or while the bobbin grasping device 11 with the empty bobbin case B grasped thereby is being transferred. Empty bobbin cases B dropped to the bobbin reception section are preferably collected, for example, to one place. In this way, it is possible to save the human operator the trouble of recovering the empty bobbin cases B from the bobbin stock section 5, 101, 110 or 150.

What is claimed is:

1. A bobbin changer apparatus for changing a lower thread bobbin mounted in a rotary hook of a sewing machine by acquiring a bobbin case, containing a lower thread bobbin, from a bobbin stock section provided apart from the rotary hook, said bobbin changer apparatus comprising:

a bobbin grasping device for grasping a bobbin case at a distal end portion of a chuck section;

a transfer mechanism for reciprocatively transferring said bobbin grasping device between the rotary hook and the bobbin stock section; and an orientation change mechanism for, in a position near one end of a stroke of transfer by said transfer mechanism of said bobbin grasping device, changing an orientation of the chuck section of said bobbin grasping device, being transferred toward the rotary hook, so that the chuck section is oriented toward the rotary hook, and changing the orientation of the chuck section of said bobbin grasping device, being transferred toward the bobbin stock section, so that the chuck section is oriented toward the bobbin stock section;

wherein said bobbin grasping device includes a moving member linearly movable by said transfer mechanism in a reciprocative manner in a first direction and second direction opposite said first direction and said chuck section is pivotally supported on said moving member, a spring member for normally biasing said chuck section so that said chuck section is oriented in said first direction, and an actuating member provided in said bobbin grasping device in such a manner that said actuating member pivots together with said chuck section;

wherein said orientation change mechanism includes a projection provided near the one end of the stroke of transfer, said projection causing the distal end portion of said chuck section to be oriented in said second direction by said actuating member abutting against said projection, during the transfer in said second direction of said bobbin grasping device, so that said actuating member pivots against a biasing force of said spring member, and an engaging mechanism for, at the one end of the stroke of transfer, engaging with said chuck section, oriented in said second direction, to thereby keep said chuck section oriented in said second direction;

wherein said actuating member of said bobbin grasping device includes first and second engaging arms provided at respective predetermined angles with respect to a pivot shaft of said chuck section, and said projection of said orientation change mechanism comprises first and second projections spaced apart from each other along the stroke of transfer near the one end of the stroke of transfer; and wherein, during the transfer in said second direction of said bobbin grasping device, the first engaging arm abuts against the first projection so that said actuating member is caused to pivot against the biasing force of said spring member and then the second engaging arm abuts against the second projection and so that said actuating member is caused to further pivot against the biasing force of said spring member, whereby the distal end portion of said chuck section is oriented in said second direction.

2. A bobbin changer apparatus as claimed in claim 1 wherein the position near the one end of the stroke of transfer where said orientation change mechanism is provided is near an end of the stroke of transfer closer to the rotary hook.

3. A sewing machine for performing sewing with an upper thread passed through a sewing needle and a lower thread paid out from a bobbin mounted in a rotary book, said sewing machine comprising:

a bobbin stock section holding at least two bobbin cases containing lower threads of different characteristics, said bobbin stock section positioning a selected one of the bobbin cases at a predetermined bobbin changing position;

a bobbin grasping device having a chuck section for grasping a bobbin case;

a transfer mechanism for transferring said bobbin grasping device between the bobbin stock section and the rotary hook; and a lower thread change control section that, in response to a lower thread change signal, performs control such that a bobbin case is taken out from the rotary hook by said bobbin grasping device, said bobbin grasping device with the bobbin case taken out from the rotary hook is transferred, by said transfer mechanism, to said bobbin stock section, a new bobbin case is positioned at the predetermined bobbin changing position of said bobbin stock section, the new bobbin case is grasped by said bobbin grasping device and then said bobbin grasping device with the new bobbin case grasped thereby is transferred, by said transfer mechanism, to the rotary hook;

wherein said bobbin stock section includes: a bobbin holder unit having a plurality of bobbin holding portions each provided for holding a bobbin case, said plurality of bobbin holding portions being arranged along a linear direction; and a mechanism for linearly driving said bobbin holder unit to position one of the bobbin holding portions at the predetermined bobbin changing position.

4. A sewing machine as claimed in claim 3 wherein said bobbin holder unit having the plurality of bobbin holding portions is detachably attached to said bobbin stock section.

5. A sewing machine as claimed in claim 3 wherein a plurality of the bobbin holder units are provided along a circumferential direction of a linear drive shaft of said bobbin stock section, and one of the bobbin holding portions is positioned at the predetermined bobbin changing position by said bobbin holder units being linearly and rotationally driven.

6. A sewing machine for performing sewing with an upper thread passed through a sewing needle and a lower thread paid out from a bobbin mounted in a rotary book, said sewing machine comprising:

a bobbin stock section holding at least two bobbin cases containing lower threads of different characteristics, said bobbin stock section positioning a selected one of the bobbin cases at a predetermined bobbin changing position;

a bobbin grasping device having a chuck section for grasping a bobbin case;

a transfer mechanism for transferring said bobbin grasping device between the bobbin stock section and the rotary hook; and a lower thread change control section that, in response to a lower thread change signal, performs control such that a bobbin case is taken out from the rotary hook by said bobbin grasping device, said bobbin grasping device with the bobbin case taken out from the rotary hook is transferred, by said transfer mechanism, to said bobbin stock section, a new bobbin case is positioned at the predetermined bobbin changing position of said bobbin stock section, the new bobbin case is grasped by said bobbin grasping device and then said bobbin grasping device with the new bobbin case grasped thereby is transferred, by said transfer mechanism, to the rotary hook;

wherein said bobbin stock section includes: a bobbin holder unit having a plurality of bobbin holding portions each provided for holding a bobbin case, said plurality of bobbin holding portions being arranged along not only a linear direction but also a rotational direction; and a mechanism for linearly and rotationally driving said bobbin holder unit to position one of the bobbin holding portions at the predetermined bobbin changing position.

* * * * *